US008872732B2

(12) United States Patent
Tani

(10) Patent No.: US 8,872,732 B2
(45) Date of Patent: Oct. 28, 2014

(54) MULTI-DISPLAY SYSTEM WITH BACKLIGHT INTENSITY CORRECTION

(75) Inventor: Daisuke Tani, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 278 days.

(21) Appl. No.: 13/447,388

(22) Filed: Apr. 16, 2012

(65) Prior Publication Data

US 2012/0268505 A1 Oct. 25, 2012

(30) Foreign Application Priority Data

Apr. 20, 2011 (JP) ..... 2011-094532

(51) Int. Cl.
*G09G 5/10* (2006.01)
*G09G 3/36* (2006.01)
*G09G 3/34* (2006.01)

(52) U.S. Cl.
CPC ..... *G09G 3/342* (2013.01); *G09G 5/10* (2013.01); *G09G 2320/0646* (2013.01); *G09G 2320/0238* (2013.01); *G09G 2320/0686* (2013.01); *G09G 2320/0633* (2013.01)
USPC ..... 345/1.3; 345/102

(58) Field of Classification Search
CPC ..... G09G 3/3426; G09G 2300/026; G09G 2300/0238; G09G 5/10; G09G 2320/0646; G09G 2320/0238; G09G 2320/0686; G09G 2320/0633; G09G 3/342
USPC ..... 345/102, 1.3
See application file for complete search history.

(56) References Cited

U.S. PATENT DOCUMENTS

| | | | | |
|---|---|---|---|---|
| 2009/0140975 | A1 | 6/2009 | Nonaka et al. | |
| 2010/0007819 | A1 | 1/2010 | Kumasaka et al. | |
| 2010/0328336 | A1 * | 12/2010 | Si | 345/102 |
| 2012/0105507 | A1 * | 5/2012 | An et al. | 345/102 |

FOREIGN PATENT DOCUMENTS

| | | | |
|---|---|---|---|
| JP | 2004-29332 | | 1/2004 |
| JP | 2008-52131 | | 3/2008 |
| JP | 2009-139470 | A | 6/2009 |
| JP | 2009-169196 | A | 7/2009 |
| JP | 2010-20961 | A | 1/2010 |
| JP | 2010-066715 | A | 3/2010 |
| WO | WO 2010150974 | A2 * | 12/2010 |

* cited by examiner

*Primary Examiner* — Allison W Johnson
(74) *Attorney, Agent, or Firm* — Renner, Otto, Boisselle & Sklar, LLP

(57) ABSTRACT

Each liquid crystal display device of a multi-display system includes a light intensity correcting section, which performs a light intensity correction in which backlight intensity of each of light intensity control areas belonging to a liquid crystal display device including the light intensity correcting section is corrected in accordance with backlight intensities of adjacent areas which are adjacent to the light intensity control area. In a case where another liquid crystal display device which is adjacent to the liquid crystal display device including the light intensity correcting section includes one of the adjacent areas, the light intensity correcting section accesses to the another liquid crystal display device via the communication section so as to obtain the backlight intensity of the one of the adjacent areas, in order to perform the light intensity correction in accordance with the obtained backlight intensity of the adjacent area.

1 Claim, 15 Drawing Sheets

MULTI-DISPLAY SYSTEM WITH BACKLIGHT INTENSITY CORRECTION

This Nonprovisional application claims priority under 35 U.S.C. §119 on Patent Application No. 2011-094532 filed in Japan on Apr. 20, 2011, the entire contents of which are hereby incorporated by reference.

TECHNICAL FIELD

The present invention relates to a multi-display system including a plurality of liquid crystal display devices arranged in array.

BACKGROUND ART

Conventionally, transmissive liquid crystal display devices are known as image display means. The transmissive liquid crystal display device is provided with a non-self-luminous liquid crystal panel and accordingly requires a backlight device.

A backlight device including a cold cathode fluorescent lamp (CCFL) as a light source has been used conventionally. Recently, however, a backlight device including a LED as a light source is widely used, which is free from disadvantages of a cold cathode fluorescent lamp, such as environmental pollution caused by mercury, or slower response speed.

In addition to solving the disadvantages of a cold cathode fluorescent lamp, the backlight device including a LED as a light source can also achieve a partial drive such as local dimming (area control) to improve a contrast ratio of an image. The local dimming will be described below.

The local dimming refers to processing for adjusting a backlight intensity of each of a plurality of areas (light intensity control areas) into which a liquid crystal panel is divided, on the basis of luminance components of image data of each of the plurality of areas. That is, in the liquid crystal display device which employs local dimming, a backlight intensity of an area displaying a bright image can be increased, whereas a backlight intensity of an area displaying a dark image can be decreased. It allows the liquid crystal display device which employs local dimming to display an image of a higher contrast ratio in which a bright image region is displayed brighter, and a dark image region is displayed darker.

However, the liquid crystal display device which employs local dimming has a disadvantage, which will be described below, in a case where one area displaying white and black images, and another area displaying only a black image are adjacent to each other, for example. That is, a backlight intensity of the area displaying white and black images is adjusted to a value in accordance with the white image (an image with high luminance components), whereas a backlight intensity of the area displaying only a black image is adjusted to a value in accordance with the black image (an image with low luminance components). This leads to a difference in brightness of displayed black between one area and another area, resulting in an unnaturally-appearing image being displayed in which a boundary between the areas is conspicuous. In order to avoid such a disadvantage, a liquid crystal display device has been proposed, which employs processing in which, after backlight intensities of respective areas are calculated on the basis of a local dimming technique, the backlight intensities of the respective areas are corrected so that no area has a light intensity differing greatly from those of adjacent areas (hereinafter referred to as a "light intensity correction"). Patent Literature 1 discloses an example of such a light intensity correction.

CITATION LISTS

Patent Literatures

Patent Literature 1
Japanese Patent Application Publication, Tokukai No. 2010-020961 A (Paragraphs [0032] through [0036] (Publication Date: Jan. 28, 2010)
Patent Literature 2
Japanese Patent Application Publication, Tokukai No. 2010-066715 A (Publication Date: Mar. 25, 2010)
Patent Literature 3
Japanese Patent Application Publication, Tokukai No. 2009-169196 A (Publication Date: Jul. 30, 2009)

SUMMARY OF INVENTION

Technical Problem

A multi-display system recently widely used, which includes a plurality of liquid crystal display devices arranged in array, cannot unfortunately perform the above-mentioned light intensity correction appropriately. The following will discuss the problem.

In a multi-display system, each liquid crystal display device includes a control circuit (IC chip) for calculating backlight intensity. Therefore, the calculation and the correction of light intensities of a backlight device on the basis of local dimming are performed for each liquid crystal display device in the multi-display system.

In other words, in each liquid crystal display device, a control circuit (i) calculates light intensities of respective areas in the liquid crystal display device with reference to image data of images to be displayed on the liquid crystal display device, and then (ii) corrects the calculated light intensities of the respective areas in the liquid crystal display device so that no area has a light intensity differing greatly from those of adjacent areas. That is, each control section of the liquid crystal display device corrects light intensities of respective areas of the liquid crystal display device including the control section, without taking into consideration a difference in or ratio in light intensities between the areas belonging to the liquid crystal display device including the control section and areas belonging to other adjacent liquid crystal display devices. Therefore, if the light intensity correction is employed in a multi-display system in which, for example, a first area of a first liquid crystal display device is adjacent to a second area of a second liquid crystal display device at an interface between the both liquid crystal display devices, then there will be such a risk that the first area displays black with a light intensity of 100% and the second area displays black with a light intensity of 0%. If such a situation is caused, a difference in brightness of black between the first area and the second area, which are adjacent to each other at the interface between the first and the second liquid crystal display devices, would be significant although both the first area and the second area suppose to display a same color (black). This causes a problem that the multi-display system as a whole displays an image that appears unnatural.

The present invention has been accomplished in view of the problem mentioned above, and an object of the present invention is to provide a multi-display system including a plurality of liquid crystal display devices arranged in array, which avoids displaying an image that appears unnatural.

Solution to Problem

In order to solve the above-mentioned problem, the present invention is a multi-display system including a plurality of liquid crystal display devices each of which includes a plurality of light intensity control areas, in each of which light intensity control areas a backlight intensity can be adjusted, wherein: liquid crystal display devices, which are adjacent to each other, are connected to each other communicatably via a communication section, and each of the plurality of liquid crystal display devices comprises a light intensity output section and a light intensity correcting section, the light intensity output section being configured to set a backlight intensity of each of light intensity control areas belonging to a liquid crystal display device including the light intensity output section, the light intensity output section setting the backlight intensity on the basis of image data of an image to be displayed on the each of light intensity control areas, the light intensity correcting section being configured to perform a light intensity correction in which the backlight intensity of each of light intensity control areas belonging to a liquid crystal display device including the light intensity correcting section is corrected in accordance with backlight intensities of adjacent areas which are adjacent to the light intensity control area, and, in a case where another liquid crystal display device which is adjacent to the liquid crystal display device including the light intensity correcting section includes one of the adjacent areas, the light intensity correcting section accessing to the another liquid crystal display device including the one of the adjacent areas via the communication section so as to obtain the backlight intensity of the one of the adjacent areas, in order to perform the light intensity correction in accordance with the obtained backlight intensity of the one of the adjacent areas.

According to the configuration of the present invention, the light intensity correcting section can perform a light intensity correction in which the backlight intensity of each of the light intensity control areas belonging to the liquid crystal display device including the light intensity correcting section is corrected in accordance with backlight intensities of adjacent areas which are adjacent to the light intensity control area. In particular, the light intensity correcting section in accordance with the present invention can correct the backlight intensity of each of the light intensity control areas belonging to the liquid crystal display device including the light intensity correcting section in accordance with backlight intensities of adjacent areas, even in a case where another liquid crystal display device which is adjacent to the liquid crystal display device including the light intensity correcting section includes one of the adjacent areas.

Therefore, the present invention can avoid a significant difference in brightness between light intensity control areas adjacent to each other in a liquid crystal display device, in a case where the light intensity control areas display sub-images whose average luminance components or the like are same or approximate. Moreover, the present invention can avoid a significant difference in brightness between light intensity control areas which are adjacent to each other at an interface between one liquid crystal display device and another adjacent liquid crystal display device, in a case where the light intensity control areas display sub-images whose average luminance components or the like are same or approximate. It is therefore possible to prevent the multi-display system including a plurality of liquid crystal display devices arranged in array from displaying an image that appears unnatural.

Advantageous Effects of Invention

According to the present invention, it is possible to prevent a multi-display system including a plurality of liquid crystal display devices arranged in array from displaying an image that appears unnatural.

DESCRIPTION OF EMBODIMENTS

A Concept of the Present Embodiment

The following will first describe how the inventor of the present invention arrived at a multi-display system in accordance with the present embodiment and a concept thereof, with reference to FIGS. 1 through 8.

Figure 1:
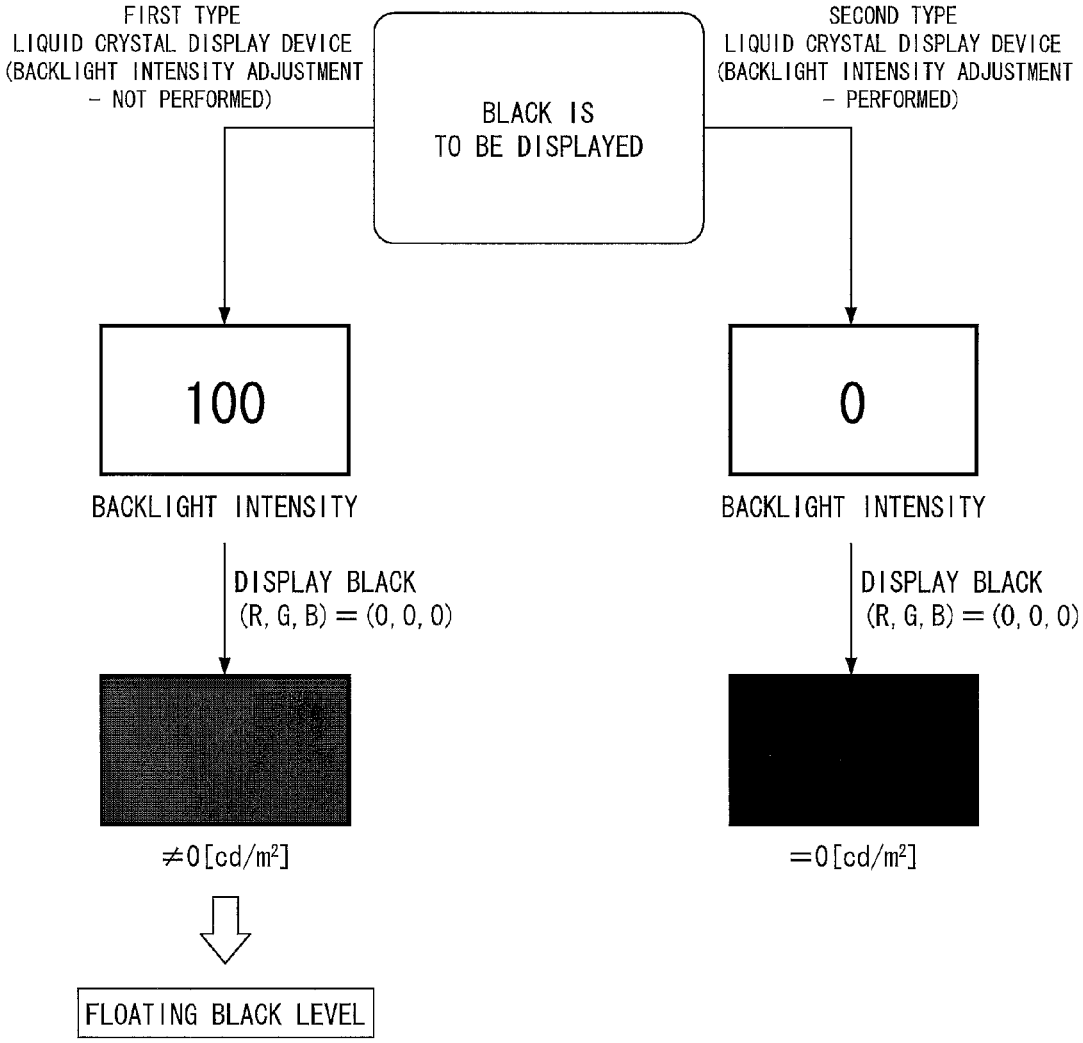
FIG. 1 illustrates a liquid crystal display device of such a type that backlight intensity is not adjusted, and a liquid crystal display device of such a type that backlight intensity can be adjusted.

In a case where a light intensity of a backlight device cannot be adjusted, as with a first type liquid crystal display device illustrated in FIG. 1, the backlight device must continue to light with the light intensity of 100%, even when a black image (black solid image) is displayed. Accordingly, light of the backlight device is slightly escaped from each pixel of a liquid crystal panel even when a black image is displayed. Due to the escape of the light, luminance of the black image never becomes zero, and so-cold floating black level is to be caused. In contrast, in a second type liquid crystal display device in which a light intensity of a backlight device can be adjusted, as illustrated in FIG. 1, a light intensity of the backlight device can be adjusted to 0% when a black image is displayed (that is, the backlight is not turned on). This makes it possible to display a true black image (a black image close to a true black) without so-cold floating black level (luminance is 0). Therefore, the second type liquid crystal display device in which a light intensity of a backlight device can be adjusted is more preferable than the first type liquid crystal display device in which a light intensity of a backlight device cannot be adjusted. Note that, in the present embodiment, a light intensity of a backlight device is denoted in percentage (unit: %), where the largest value of the output light intensity is 100.

Recently, liquid crystal display devices are widely used each of which can employ local dimming. In the local dimming, a liquid crystal panel is divided into a plurality of areas (light intensity control areas) and, on the basis of image data of each of the divided areas, a light intensity of a backlight device is adjusted for the each area. Specifically, with respect to the each area, a statistic (an average, a median or the like) of luminance components of image data of an image to be displayed is calculated and in accordance with the statistic of the luminance components, a light intensity of the backlight device is obtained. The luminance components (Y) refer to values (i) indicating brightness of the image indicated by the image data and (ii) being obtained from R, B, and G values of the image data.

Note further that, in the present specification, the term "luminance" means, when used solely, a measure indicating brightness of an image actually displayed (for example, a photometric value), whereas, the term "luminance component" means a value indicating brightness of an image, which brightness is obtained from image data.

Figure 2:
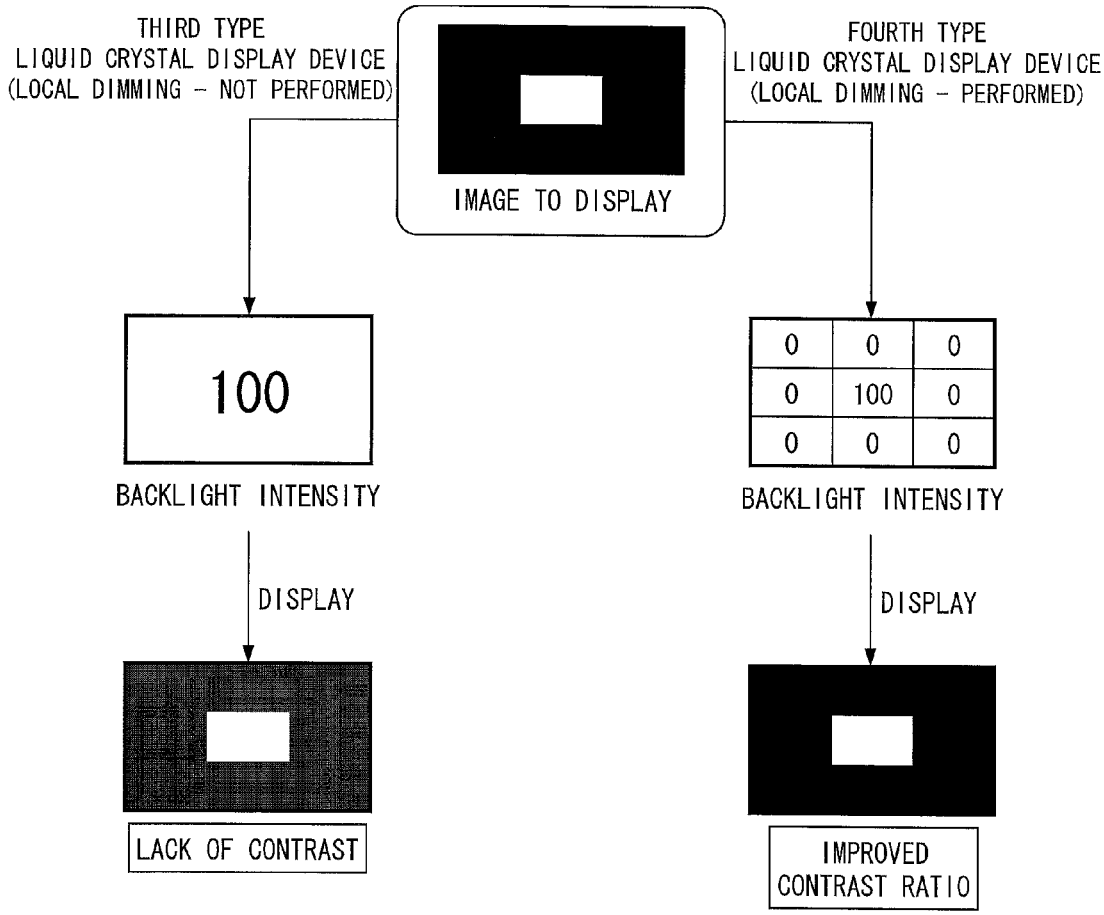
FIG. 2 illustrates a liquid crystal display device of a type which does not employ local dimming, and a liquid crystal display device of a type which can employ local dimming.

Next, an advantage of local dimming will be described with reference to FIG. 2. When a liquid crystal display device which does not employ local dimming, such as a third type liquid crystal display device illustrated in FIG. 2, displays an image including both a black image and a white image (a white solid image), the black image would be floating black level, since a backlight device emits light to the black image with a light intensity same as that of light emitted to the white image. Therefore, an image displayed on the third type liquid crystal display device which does not employ local dimming would lack contrast to some extent. On the other hand, when a liquid crystal display device which employs local dimming, such as a fourth type liquid crystal display device illustrated in FIG. 2, displays an image including both a black image and a white image, such control is possible that the white image is irradiated with light from a backlight device with a light intensity of 100%, whereas no light is irradiated to the black image. Therefore, as illustrated in FIG. 2, the fourth type liquid crystal display device capable of employing local dimming can display an image having a higher contrast ratio than that of the third type liquid crystal display device. Further, the fourth type liquid crystal display device capable of employing local dimming can reduce electric power consumption, since the backlight intensity of the fourth type liquid crystal display device is lower than that of the third type liquid crystal display device.

However, local dimming offers not only the above-mentioned advantage of capable of displaying an image with a high contrast ratio but also a disadvantage. The following will discuss the disadvantage with reference to FIG. 3.

Figure 3:
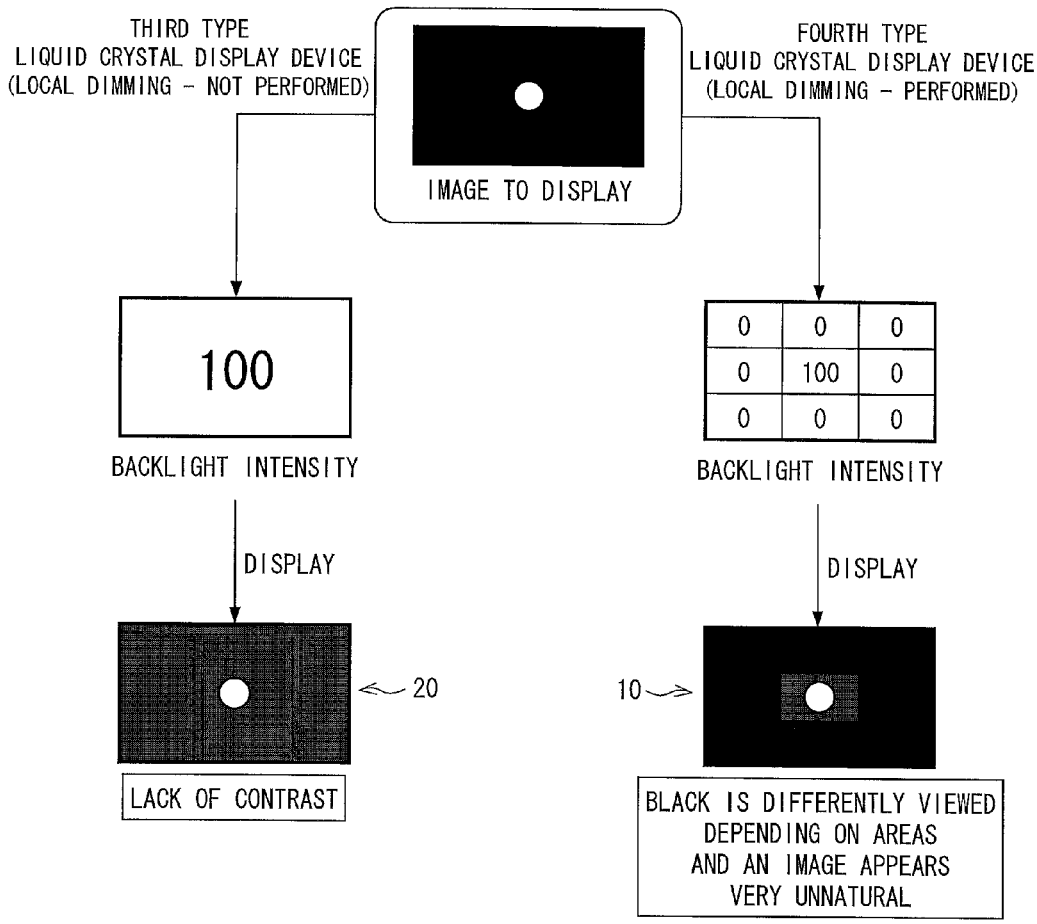
FIG. 3 is a diagram illustrating a problem caused in the liquid crystal display device of a type which can employ local dimming.

As illustrated in FIG. 3, it is assumed that, of a plurality of areas of a liquid crystal display device, the central area displays an image including both a white image and a black image, whereas other areas display only black images. In the fourth type liquid crystal display device as illustrated in FIG. 3, it is defined by local dimming that a light intensity of the central area is 100% and light intensities of other areas are 0%. Accordingly, in the fourth type liquid crystal display device, the central area significantly differs from the other areas in luminance of black, as indicated by a reference numeral 10 in FIG. 3. This will disadvantageously cause an unnaturally-appearing image to be displayed in which a boundary between the areas is conspicuous. Such a disadvantage is not caused in the third type liquid crystal display device which does not employ local dimming since a light intensity is not adjusted for each area, as indicated by a reference numeral 20 in FIG. 3, however, the third type liquid crystal display device has the above-described disadvantage of lacking contrast to some extent.

In order to maintain displaying an image with a high contrast ratio, avoiding the disadvantage of local dimming, a liquid crystal display device can perform processing in which, after light intensities of respective areas are calculated on the basis of a local dimming technique, the calculated light intensities of the respective areas (the light intensity of a backlight device) are corrected so that no area has a light intensity differing greatly from those of adjacent areas. The following will describe the correction in detail.

Figure 4:
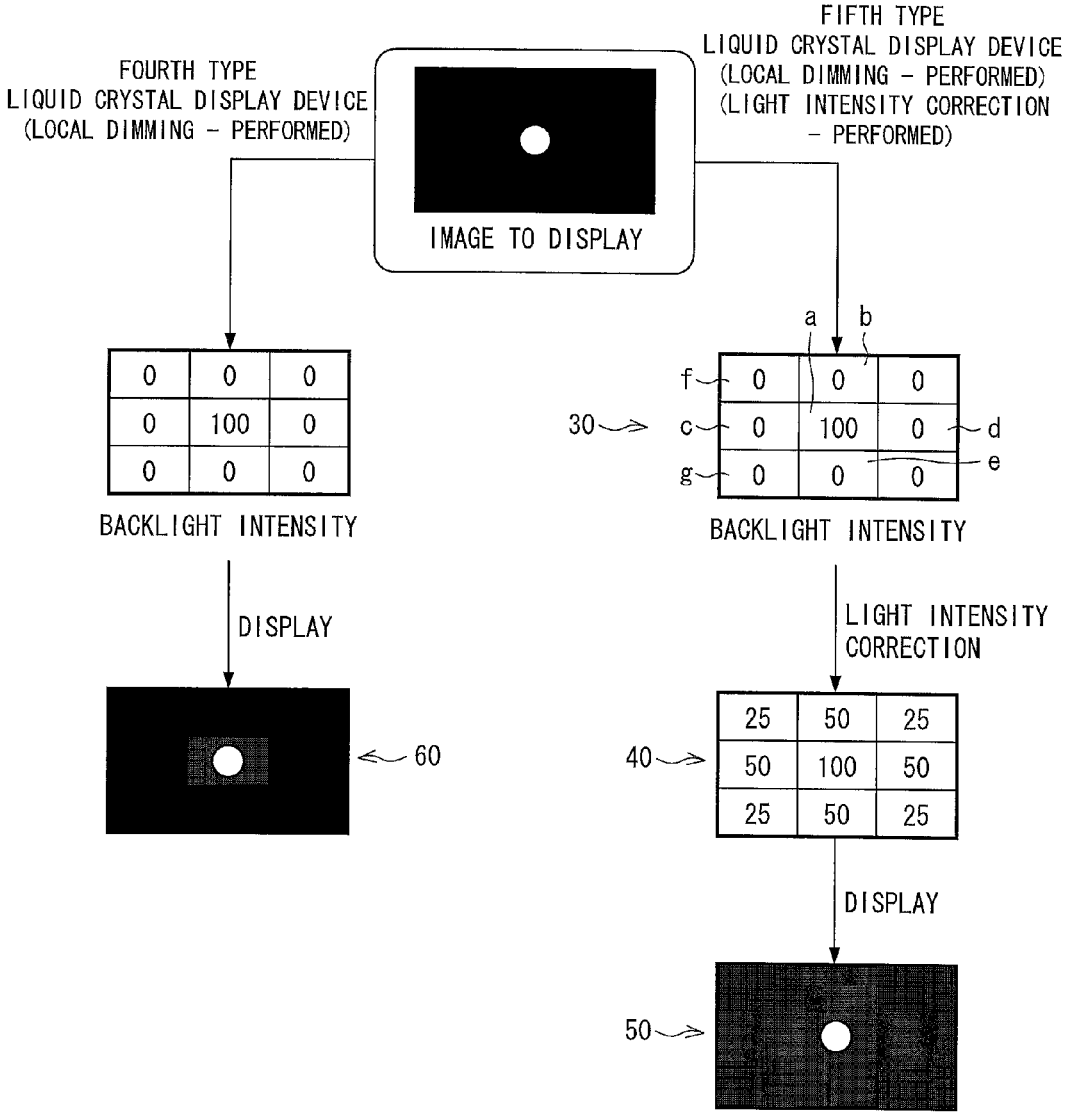
FIG. 4 illustrates a liquid crystal display device of such a type that, after a light intensity of each area is calculated on the basis of a local dimming technique, the light intensity of each area is corrected.

If, of two adjacent areas, a light intensity of one area is defined as the maximum value (100%) and a light intensity of the other area is defined as the minimum value (0%), as with the case of local dimming of the fourth type liquid crystal display device illustrated in FIGS. 3 and 4, then a boundary between the areas will be conspicuous. Specifically, in the fourth type liquid crystal display device as illustrated in FIGS. 3 and 4, the central area and areas adjacent to the central area significantly differ from each other in luminance of black, although both areas display black images. This is because the light intensity of the central area is defined as the maximum value (100%) whereas the light intensities of the areas adjacent to the central area are defined as the minimum value (0%). This will cause an unnaturally-appearing image to be displayed.

The disadvantage of local dimming can be solved, when, after light intensities of respective areas are calculated on the basis of the local dimming technique, the calculated light intensities of the respective areas are corrected so that no area has a light intensity differing greatly from those of adjacent areas, as with a fifth type liquid crystal display device illustrated in FIG. 4. The correction is referred to as the light intensity correction. The following will describes a flow of processing of the light intensity correction with reference to the flow chart of FIG. 8.

Figure 8:
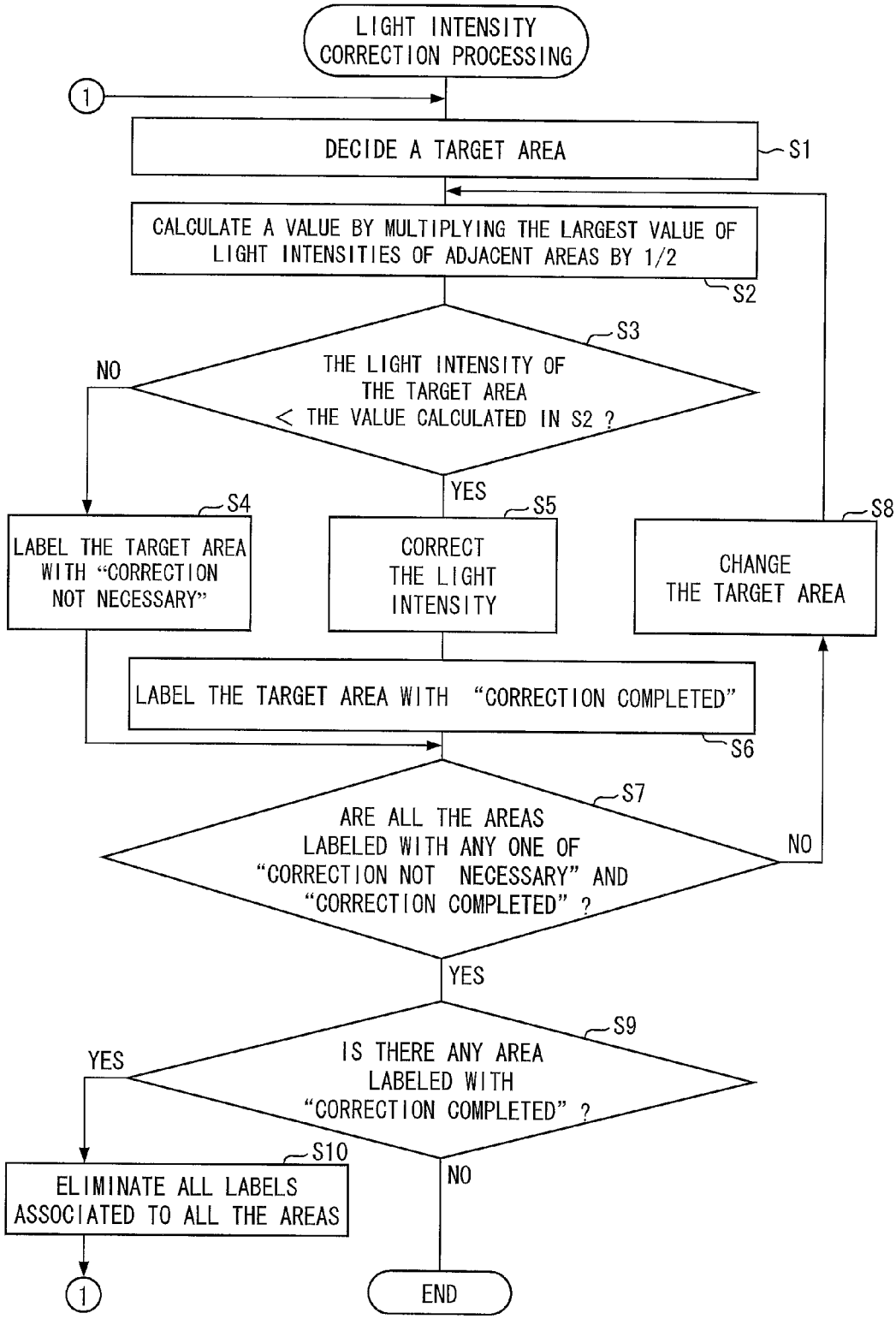
FIG. 8 is a flow chart illustrating a flow of light intensity correction processing.

Before performing the processing illustrated in FIG. 8, a control section (IC chip) of the fifth type liquid crystal display device first calculates, with the use of the local dimming technique, a light intensity of each area on the basis of a statistic (an average or the like) of luminance components of image data of the each area. The calculated light intensity of the each area is indicated in a reference numeral 30 of FIG. 4.

After calculating the light intensity of the each area, the control section decides, as a target area, any one of all the areas, as illustrated in FIG. 8 (S1).

Subsequently, the control section calculates a value by multiplying the largest light intensity of the light intensities of adjacent areas by ½ (half the largest light intensity value), the adjacent areas being adjacent to the target area (S2). Note that, if the calculated value includes fractions below decimal point, the fractions are then rounded up.

Further, the adjacent areas refer to four areas: a right area right adjacent to a target area, a left area left adjacent to the target area, an upper area upward adjacent to the target area, and a lower area downward adjacent to the target area. However, in a case where an area located at the end of a display panel is a target area, the adjacent areas refer to two or three areas, since there lacks one or two areas, of the left area, the right area, the upper area, and the lower area. For example, in a case where an area a in FIG. 4 is a target area, an area b, an area c, an area d, and an area e are adjacent areas. Furthermore, in a case where the area c in FIG. 4 is a target area, the area a, an area f, and an area g are adjacent areas.

Accordingly, for example, in a case where the area a is a target area, the calculated value in S2 is 0 since all of the four adjacent areas have the light intensity value of 0. Further, for example, in a case where the area c is a target area, the calculated value in S2 is 50 since the largest value of the light intensity values of the three adjacent areas is 100.

After S2, the control section determines whether or not the light intensity of the target area is lower than the value calculated in S2 (S3).

In a case where it is determined that the light intensity of the target area is not lower than the value calculated in S2, that is, the light intensity of the target area is equal to or higher than the value calculated in S2, the control section labels the target area with "Correction Not Necessary" (S4), and the processing goes to S7.

In contrast, in a case where it is determined that the light intensity of the target area is lower than the value calculated in S2, the control section corrects the light intensity of the target area (S5). Specifically, the control section corrects, in S5, the light intensity of the target area to the value calculated in S2. Accordingly, in a case where the area c illustrated in FIG. 4 is a target area, the light intensity of the target area will be corrected from 0 to 50. After S5, the control section labels the target area with "Correction Completed" (S6) and the processing goes to S7.

In S7, the control section determines whether or not all the areas of the liquid crystal display device are labeled with any one of "Correction Not Necessary" and "Correction Completed". In a case where the control section determined that not all the areas are labeled with any one of "Correction Not Necessary" and "Correction Completed" (No in S7), the control section changes the target area to an area which is labeled with none of "Correction Not Necessary" and "Correction Completed" (S8), and the processing from S2 is repeated. That is, the area labeled with none of "Correction Not Necessary" and "Correction Completed" is set to a target area (S8), and the processing from S2 is repeated. Therefore, the processing from S2 to S7 is repeated until all the areas have been once a target area. Whereas, in a case where the control section determines that all the areas of the liquid crystal display device are labeled with any one of "Correction Not Necessary" and "Correction Completed" (Yes in S7), the processing goes to S9.

In S9, the control section determines whether or not there exists any area labeled with "Correction Completed". In a case where the control section determines that there exists any area labeled with "Correction Completed" (Yes in S9), the control section eliminates all labels associated to all the areas (S10), and the processing from S1 is repeated. Whereas, in a case where the control section determines that there exists no area labeled with "Correction Completed", the control section ends the processing illustrated in the flow chart of FIG. 8. Accordingly, when the light intensity correction has been performed on at least one target area during one processing, another one processing will be repeated, on the premise that each of the areas included in the fifth type liquid crystal display device is treated once as a target area and steps of S2 through S7 sequentially performed for each of the areas are regarded as one processing, whereas when no light intensity correction has been performed during one processing, the processing will end. Therefore, the processing of FIG. 8 will be continued while the light intensity correction is performed on at least one area during one processing, and the processing of FIG. 8 will end when no light intensity correction is required for any area during one processing.

As a result of the processing illustrated in FIG. 8, light intensities of a backlight device of the fifth type liquid crystal display device, which light intensities are indicated by the reference numeral 30 in FIG. 4, will be corrected to the values indicated by the reference numeral 40 in FIG. 4. This makes it possible to reduce the difference in light intensity between the central area and the adjacent areas from 100 to 50, and the difference in light intensity between the central area and areas other than the adjacent areas from 100 to 75. Therefore, an image can be displayed in which the difference in luminance of black between the central area and areas other than the central area is reduced, overcoming the disadvantage of local dimming. Moreover, the lack of contrast is improved.

In other words, the light intensity correction is performed such that the maximum value (absolute value) of the difference in backlight intensity between areas adjacent to each other is reduced compared with that before the light intensity correction. Further, light intensities of the areas included in the fifth type liquid crystal display device are corrected such that, of light intensities of the adjacent areas, the smaller light intensity is not less than a half the larger light intensity. Consequently, assuming that a histogram where a horizontal axis indicates locations of areas and a vertical axis indicates light intensities of the areas is illustrated, changes in difference in light intensity before the light intensity correction are sharp (the reference numeral 30 in FIG. 4) whereas changes in difference in light intensity after the light intensity correction are mild (the reference numeral 40 in FIG. 4). This allows displaying an image in which a large difference in luminance between areas adjacent to each other is prevented, i.e., the disadvantage of local dimming is overcome.

The following will discuss local dimming in the multi-display system including a plurality of liquid crystal display devices arranged in array.

Figure 5:
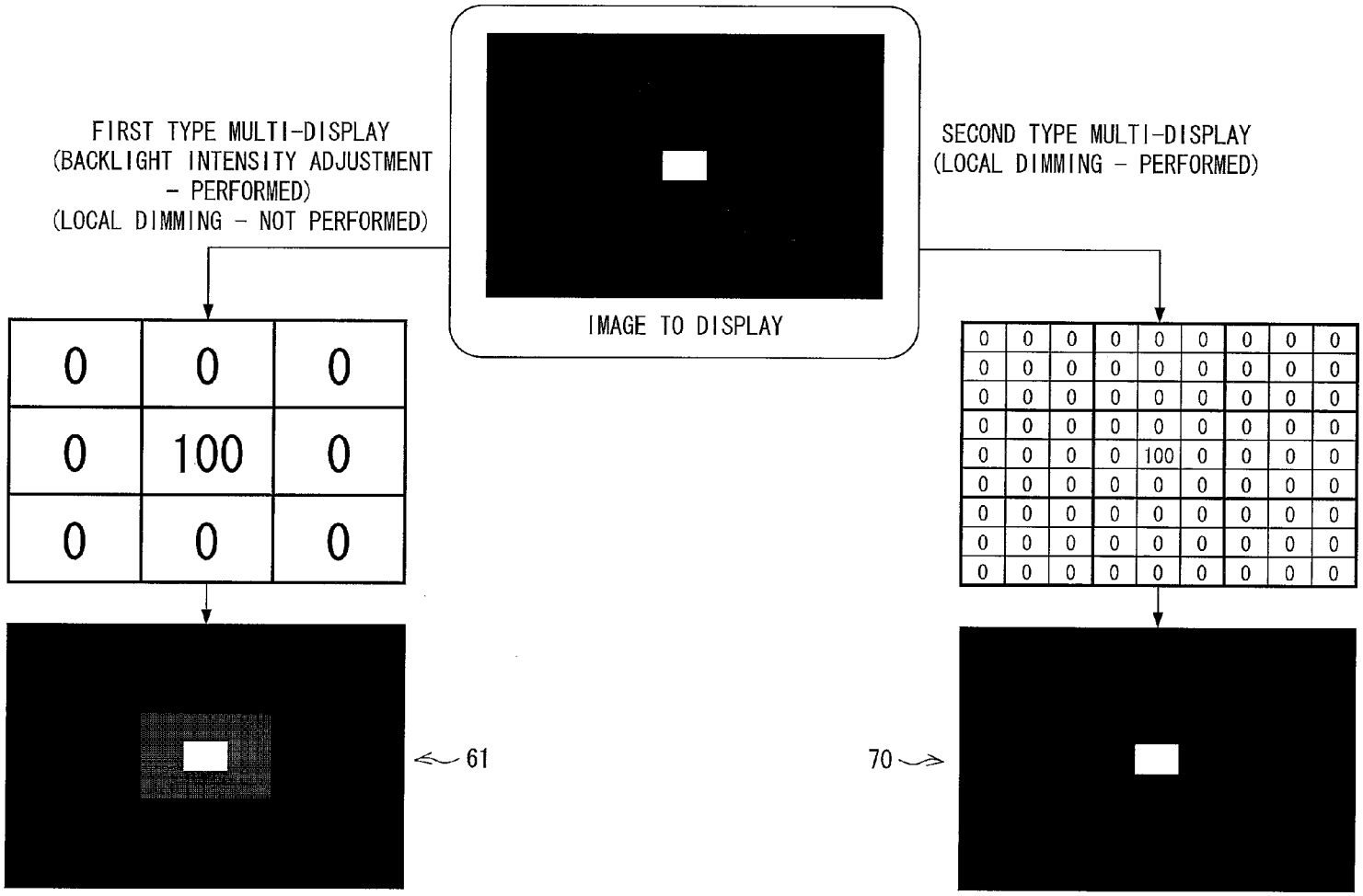
FIG. 5 is a diagram illustrating local dimming in a multi-display system.

FIG. 5 exemplifies two multi-display systems: a first type multi-display system including a plurality of liquid crystal display devices in each of which a backlight intensity can be adjusted but local dimming is not employed, and a second type multi-display system including a plurality of liquid crystal display devices in each of which can employ local dimming (both systems include 9 liquid crystal display devices arranged in a matrix).

It is assumed that, in both of the multi-display systems, only a central area of a liquid crystal display device located in the central (referred hereinafter as a central liquid crystal display device) displays a white image and other areas of the central liquid crystal display device and other liquid crystal display devices display black images.

In this case, as illustrated in FIG. 5, in the first type multi-display system, a light intensity of the entire central liquid crystal display device is defined as 100% although the central liquid crystal display device also includes areas displaying black images, whereas light intensity values of the other liquid crystal display devices which display black images are defined as 0%. In the first type multi-display system, therefore, luminance of black is different between the central liquid crystal display device and other liquid crystal display devices, so that the first type multi-display system as a whole disadvantageously display an unnaturally-appearing image, as indicated by a reference numeral 61 in FIG. 5.

In contrast, in the second type multi-display system capable of employing local dimming, such a control is possible that a white image of the central liquid crystal display device is irradiated from a backlight device with backlight with a light intensity of 100%, whereas no backlight is irradiated to areas displaying black images and other liquid crystal display devices displaying merely black images (a light intensity of each of the areas displaying black images is 0%). Therefore, as indicated by a reference numeral 70 in FIG. 5, the second type multi-display system does not display an unnaturally-appearing image, differently from the image illustrated by the reference numeral 61 in FIG. 5, since luminance of black is equivalent between the central liquid crystal display device and other liquid crystal display devices. Consequently, it is preferable that not only each liquid crystal display device but also a multi-display system employs local dimming.

However, if a multi-display system just employs local dimming, it will then cause the same problem as with the fourth type liquid crystal display device illustrated in FIG. 4. That is, in a case where, of a plurality of areas belonging to one of the liquid crystal display devices included in the multi-display system, one area displays both white and black images, and other areas display only black images, an unnaturally-appearing image would be displayed as indicated by the reference numeral 60 in FIG. 4. In order to avoid such a disadvantage, it is considered that the light intensity correction should be performed also in the multi-display system, as with the fifth type liquid crystal display device illustrated in FIG. 4.

However, just performing the light intensity correction in the multi-display system would cause another problem. The following will discuss the problem. In a multi-display system, each liquid crystal display device includes a control section (IC chip) for calculating backlight intensities. Therefore, in the multi-display system, the calculation of light intensities in the local dimming and the light intensity correction are performed for each liquid crystal display device. That is, each control section of the liquid crystal display device calculates a light intensity of each area of the liquid crystal display device, with reference to image data of images to be displayed on the liquid crystal display device, and then corrects the light intensity of each area of the liquid crystal display device with reference to light intensity values of other areas of the liquid crystal display device.

In other words, each liquid crystal display device does not input image data or light intensities of other liquid crystal display devices, so that the control section of the each liquid crystal display device cannot refer to light intensities of areas of the other liquid crystal display devices. Therefore, the control section of each liquid crystal display device corrects light intensities of areas belonging to the liquid crystal display device including the control section, without taking into consideration a difference in or ratio of light intensity between the areas belonging to the liquid crystal display device including the control section and areas belonging to other adjacent liquid crystal display devices.

Figure 6:
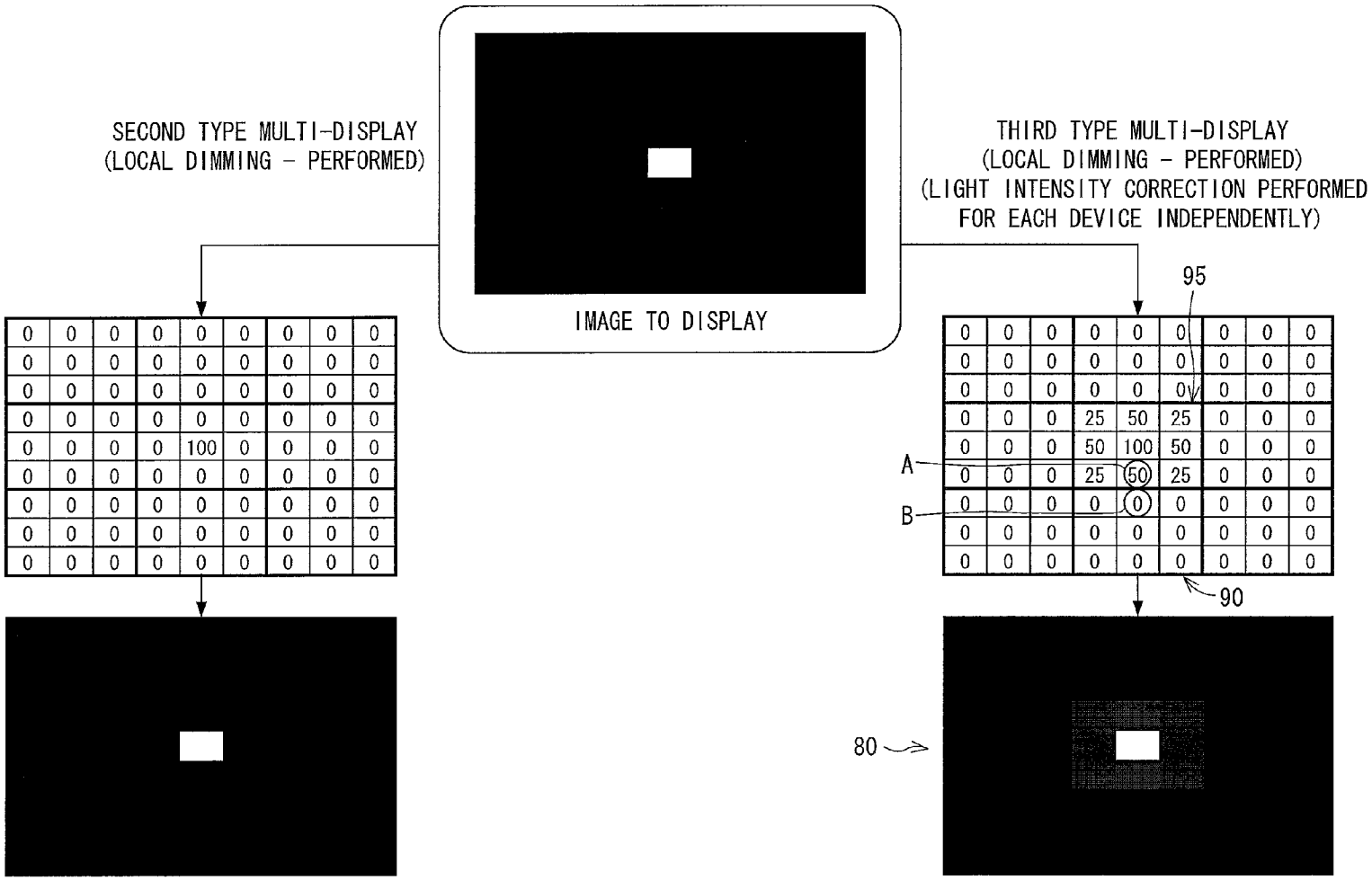
FIG. 6 is a diagram illustrating a problem of a multi-display system in which both local dimming and a light intensity correction are performed.

Therefore, although both the local dimming and the light intensity correction are performed, such a situation as exemplified by a third type multi-display system in FIG. 6 would be caused that an area A of a central liquid crystal display device 95 displays black with a light intensity value of 50%, and an area B, which belongs to an adjacent liquid crystal display device 90 and is located adjacent to the area A, displays black with a light intensity value of 0%. The situation is caused because a control section of the liquid crystal display device 90 including the area B can only refer to, of light intensities of areas adjacent to the area B, the light intensities (0%) of areas belonging to the liquid crystal display device 90 but cannot refer to the light intensity (50%) of the area A belonging to the liquid crystal display device 95 located adjacent to the liquid crystal display device 90, i.e., the control section of the liquid crystal display device 90 including the area B cannot correct the light intensity of the area B in accordance with the light intensity of the area A.

Figure 7:
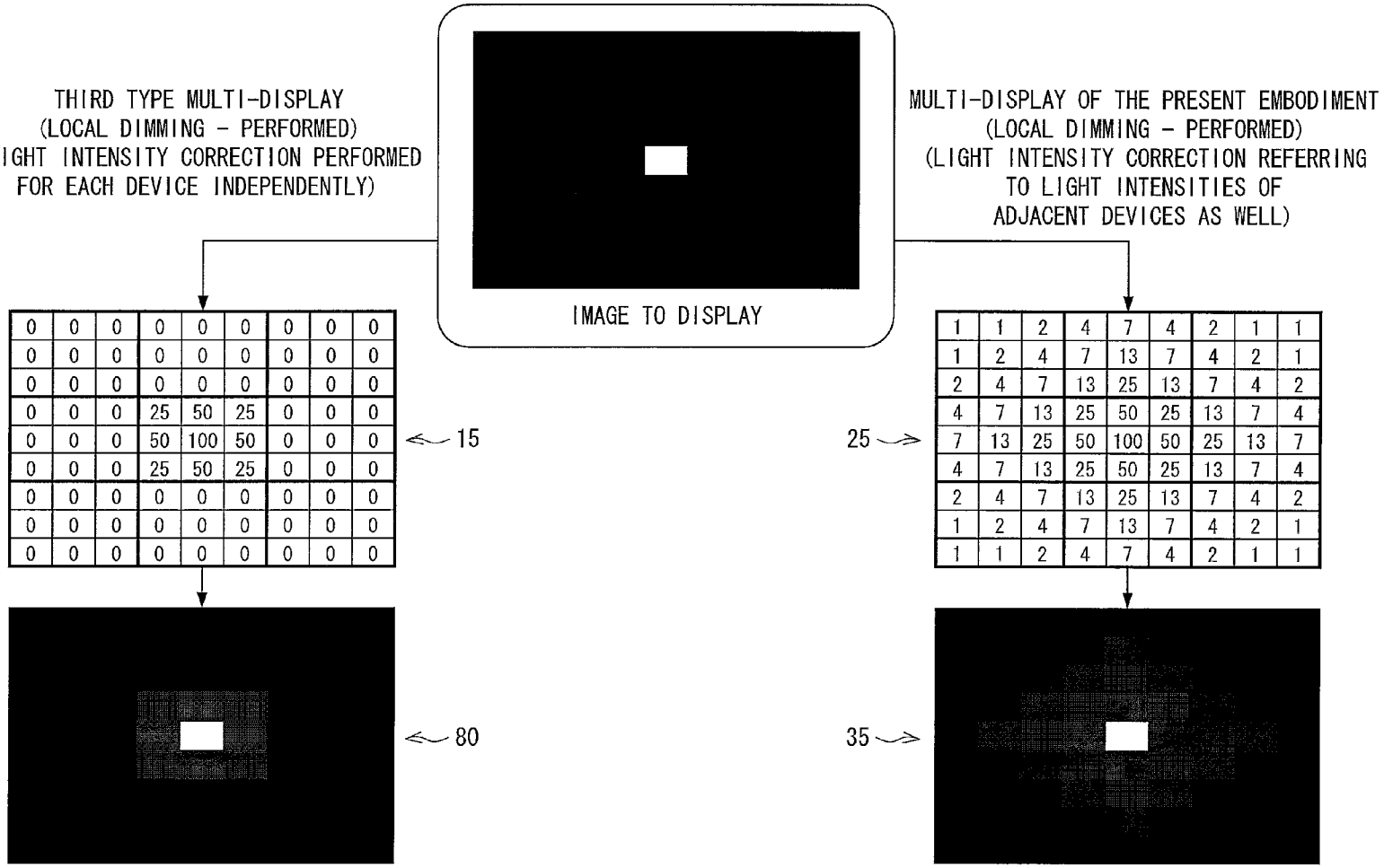
FIG. 7 is a diagram illustrating a concept of a multi-display system in accordance with the present embodiment.

If such a situation is caused, as indicated by a reference numeral 80 in FIG. 6 or 7, luminance of black is significantly difference between one liquid crystal display device and other liquid crystal display devices. This causes a multi-display system as a whole to display an unnaturally-appearing image.

In order to prevent the problem, in the multi-display system of the present embodiment, the light intensity correction can be performed for each area of each liquid crystal display device, instead of a light intensity correction performed independently for each liquid crystal display device, so as to correct light intensities of areas which (i) belong to different liquid crystal display devices and (ii) are adjacent to each other at an interface between these different liquid crystal display devices, with reference to the mutual light intensities. That is, in a case where adjacent areas which are adjacent to a target area encompass (i) adjacent areas belonging to a liquid crystal display device including the target area, and (ii) an adjacent area belonging to another liquid crystal display device adjacent to the liquid crystal display device including the target area, the light intensity of the target area can be corrected, with reference to not only the light intensity of the adjacent areas belonging to the liquid crystal display device including the target area but also the light intensity of the adjacent area belonging to the another liquid crystal display device adjacent to the liquid crystal display device including the target area. Specifically, in a case where, of adjacent areas which are adjacent to a target area, one or two adjacent areas is/are included in other one or two liquid crystal display devices adjacent to the liquid crystal display device including the target area, it is determined whether or not the light intensity correction of the target area should be made, with reference to not only the light intensities of the adjacent areas belonging to the liquid crystal display device including the target area but also the light intensity(s) of the one or two adjacent areas belonging to other one or two liquid crystal display devices adjacent to the liquid crystal display device including the target area. And, if necessary, the light intensity of the target area will be corrected, in accordance with light intensity(s) of the one or two areas belonging to other one or two liquid crystal display devices adjacent to the liquid crystal display device including the target area.

Accordingly, as indicated by a reference numeral 35 in FIG. 7, the present embodiment can achieve the light intensity correction such that a difference in light intensity between liquid crystal display devices located adjacent to each other is reduced. This further allows that a difference in luminance of black between liquid crystal display devices located adjacent to each other is reduced, thereby preventing a multi-display system as a whole from displaying an image that appears unnatural.

A Configuration of the System of the Present Embodiment

The following will describe a configuration and processing contents of the multi-display system in accordance with the present embodiment with reference to FIGS. 9 through 15.

Figure 9:
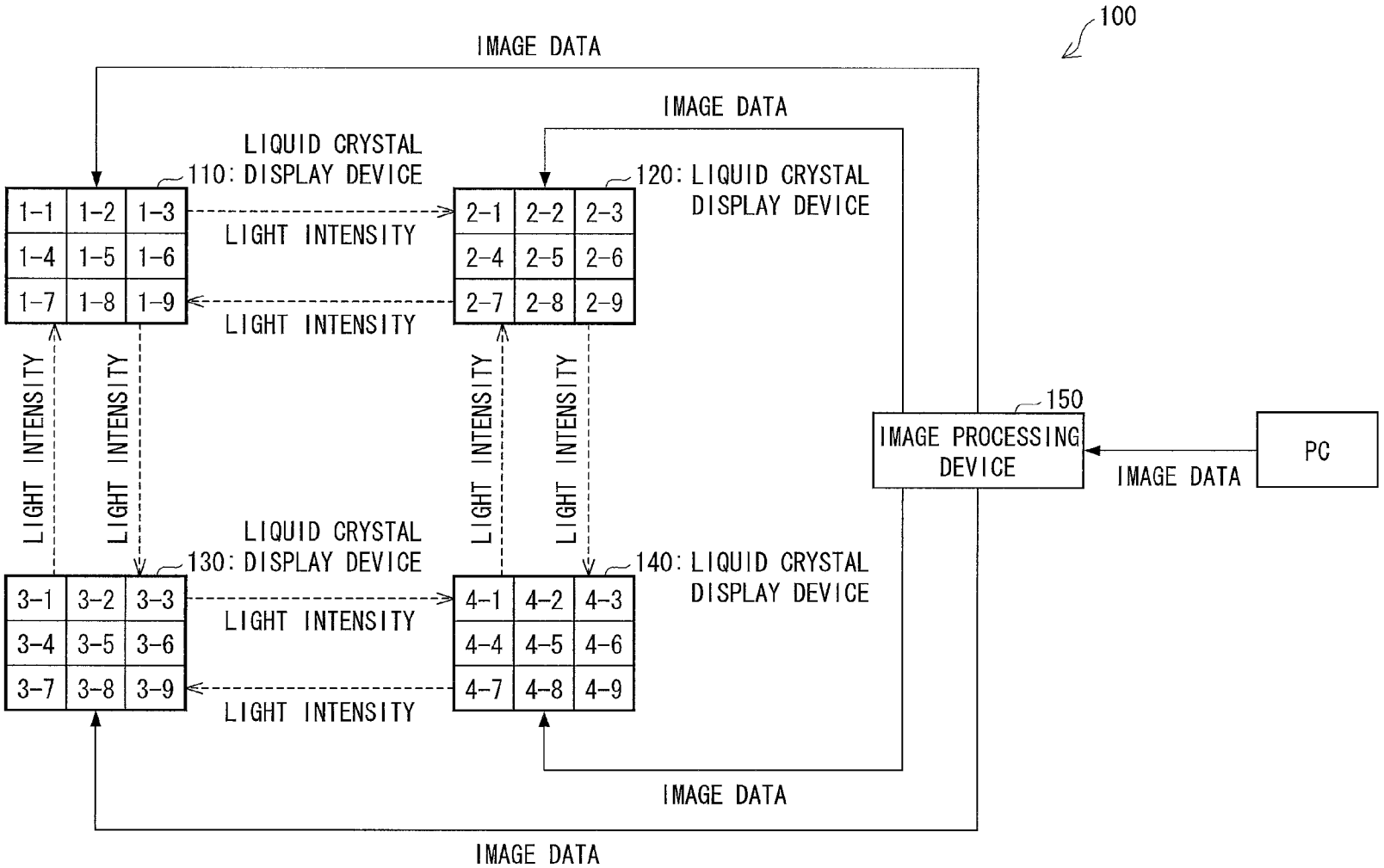
FIG. 9 is a diagram illustrating a configuration of the multi-display system in accordance with the present embodiment.

As illustrated in FIG. 9, a multi-display system 100 of the present embodiment includes liquid crystal display devices 110, 120, 130, and 140, which are arranged in a matrix, and an image processing device 150 connected to each of the liquid crystal display devices 110, 120, 130, and 140 communicatably.

The image processing device 150 is connected to each of the liquid crystal display devices 110, 120, 130, and 140 in a communication-enabled manner via known communication means such as an HDMI (High Definition Multimedia Interface) and a DVI (Digital Visual Interface).

The image processing device 150 is a computer for (i) inputting, from an external device such as a PC (personal computer), image data of an image to be displayed on each of the liquid crystal display devices 110, 120, 130, and 140 included in the multi-display system 100, (ii) performing image processing with respect to the inputted image data, and (iii) sending image data after the image processing to each of the liquid crystal display devices 110, 120, 130, and 140. The liquid crystal display devices 110, 120, 130, and 140 respectively receive image data of images to be displayed on the respective liquid crystal display devices.

Specifically, after inputting from the PC image data of an image to be displayed on the entire multi-display system 100, the image processing device 150 divides the image of the inputted image data into four sub-images, and sends the image data of the divided sub-images to the respective liquid crystal display devices 110, 120, 130, and 140. That is, the image processing device 150 divides one image into an upper-left sub-image, an upper-right sub-image, a lower-left sub-image, and a lower-right sub-image. Then, the image processing device 150 sends the image data of the upper-left sub-image to the liquid crystal display device 110, the image data of the lower-left sub-image to the liquid crystal display device 130, the image data of the upper-right sub-image to the liquid crystal display device 120, and the image data of the lower-right sub-image to the liquid crystal display device 140.

Although, in the present embodiment, the processing for dividing an image is performed by the image processing device 150 as described above, the processing can be performed by the PC in FIG. 9. In this case, the PC divides an image to be displayed on the entire multi-display system 100 into four sub-images, and sends all of four image data obtained by the processing to the image processing device 150, which sends respectively the image data to the liquid crystal display devices 110, 120, 130, and 140. Alternatively, the PC divides an image to be displayed on the entire multi-display system 100 into four sub-images and sends image data of the divided sub-images respectively to the liquid crystal display devices 110, 120, 130, and 140 without the intermediating image processing device 150 (in this case, the image processing device 150 is not necessary).

Each of the liquid crystal display devices 110, 120, 130, and 140 is a transmissive liquid crystal display device and is divided into nine areas (light intensity control areas) arranged in a matrix, in which a backlight intensity of each of the areas can be adjusted. The liquid crystal display device 110 includes nine areas (1-1) through (1-9), the liquid crystal display device 120 includes nine areas (2-1) through (2-9), the liquid crystal display device 130 includes nine areas (3-1) through (3-9), and the liquid crystal display device 140 includes nine areas (4-1) through (4-9).

Further, as illustrated in FIG. 9, the liquid crystal display device 110 is adjacent to the liquid crystal display devices 120 and 130, the liquid crystal display device 120 is adjacent to the liquid crystal display devices 110 and 140, the liquid crystal display device 130 is adjacent to the liquid crystal display devices 110 and 140, and the liquid crystal display device 140 is adjacent to the liquid crystal display devices 120 and 130.

Further, in the present embodiment, each of the liquid crystal display devices 110, 120, 130, and 140 is communicatably connected to each of other liquid crystal display devices adjacent to the each liquid crystal display device via a USB (Universal Serial Bus) as a communication section. That is, the liquid crystal display device 110 is capable of communicating data with the liquid crystal display devices 120 and 130, the liquid crystal display device 120 is capable of communicating data with the liquid crystal display devices 110 and 140, the liquid crystal display device 130 is capable of communicating data with the liquid crystal display devices 110 and 140, and the liquid crystal display device 140 is capable of communicating data with the liquid crystal display devices 120 and 130. Note that the communication section is not limited to a USB, and can be a LAN (Local Area Network), or an RS232-C.

The following will describe the liquid crystal display device 110. Note that each of the liquid crystal display devices 120, 130, and 140 has configurations same as that of the liquid crystal display device 110, and includes same components as those included in the liquid crystal display device 110. Accordingly, the following will describe merely the liquid crystal display device 110 and the descriptions of the liquid crystal display devices 120, 130, and 140 will be omitted.

The liquid crystal display device 110 includes: a liquid crystal panel; a drive circuit for driving the liquid crystal panel; a backlight device for irradiating areas of the liquid crystal panel; and a light intensity determining section for determining light intensities (irradiated light intensities) of backlight emitted from the backlight device to the areas of the liquid crystal panel. That is, the drive circuit drives the liquid crystal panel on the basis of the image data sent from the image processing device 150 to the liquid crystal display device 110, and the liquid crystal panel displays an image on the basis of the image data. The light intensity determining section determines backlight intensities of the areas of the liquid crystal panel on the basis of the image data sent from the image processing device 150 and the backlight device irradiates each of the areas of the liquid crystal panel with backlight of the light intensity determined by the light intensity determining section.

Figure 10:
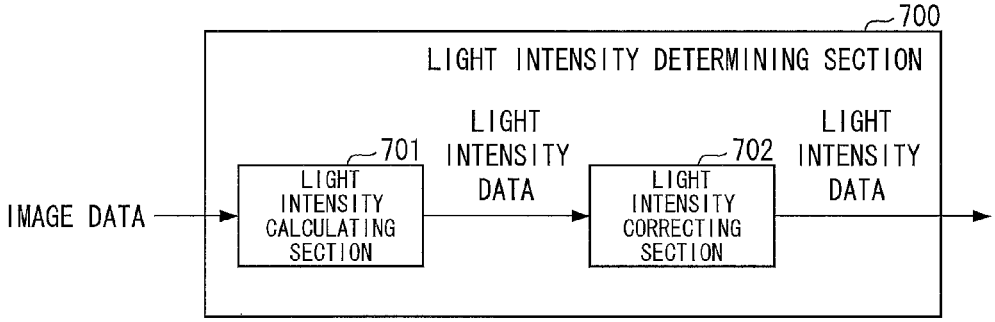
FIG. 10 is a block diagram illustrating a light intensity determining section included in each of liquid crystal display devices included in the multi-display system in accordance with the present embodiment.

The following will detail the light intensity determining section for determining light intensities of the backlight device. A light intensity determining section 700 is an integrated circuit and includes, as illustrated in FIG. 10, a light intensity calculating section 701*a* and a light intensity correcting section 702.

The light intensity calculating section 701 inputs image data sent from the image processing device 150 to the liquid crystal display device 110, and calculates (sets) backlight intensities of areas belonging to the liquid crystal display device 110, on the basis of the image data (calculation of light intensities on the basis of the local dimming technique). That is, the light intensity calculating section 701 calculates statistics (averages or the like) of luminance components of image data of sub-images to be displayed on the respective areas (1-1) through (1-9) illustrated in FIG. 9, and determines backlight intensities in accordance with the statistics of the luminance components.

Specifically, a conversion formula is to be stored such that a higher light intensity value is calculated for an area having a higher statistic of luminance components (a brighter area), and a smaller light intensity value is calculated for an area having a lower statistic of luminance components (a darker area), since the lower a luminance component is, the darker the image is, and the higher a luminance component is, the brighter the image is. And, the light intensity calculating section 701 calculates, with use of the image data sent from the image processing device 150, statistics of luminance components of the areas (1-1) through (1-9), and outputs (calculates), with the use of the calculated statistics of luminance components and the conversion formula, the light intensities of the areas (1-1) through (1-9). With this measure, a higher light intensity value is calculated for an area having a higher statistic (an average or the like) of luminance components, and a smaller light intensity value is calculated for an area having a lower statistic of luminance components. Instead of the conversion formula used in the present embodiment to obtain the light intensities, a conversion table can be used, which conversion table is configured such that a higher light intensity value is outputted for an area having a higher statistic (an average or the like) of luminance components, and a smaller light intensity value is outputted for an area having a lower statistic (an average or the like) of luminance components.

So far, the light intensity calculating section 701 of the liquid crystal display device 110 has been described. A light intensity calculating section 701 of the liquid crystal display device 120 calculates respective backlight intensities of the areas (2-1) through (2-9), on the basis of respective luminance components of sub-images to be displayed thereon. A light intensity calculating section 701 of the liquid crystal display device 130 calculates respective backlight intensities of the areas (3-1) through (3-9), on the basis of respective luminance components of sub-images to be displayed thereon. A light intensity calculating section 701 of the liquid crystal display device 140 calculates respective backlight intensities of the areas (4-1) through (4-9), on the basis of respective luminance components of sub-images to be displayed thereon.

Figure 11:
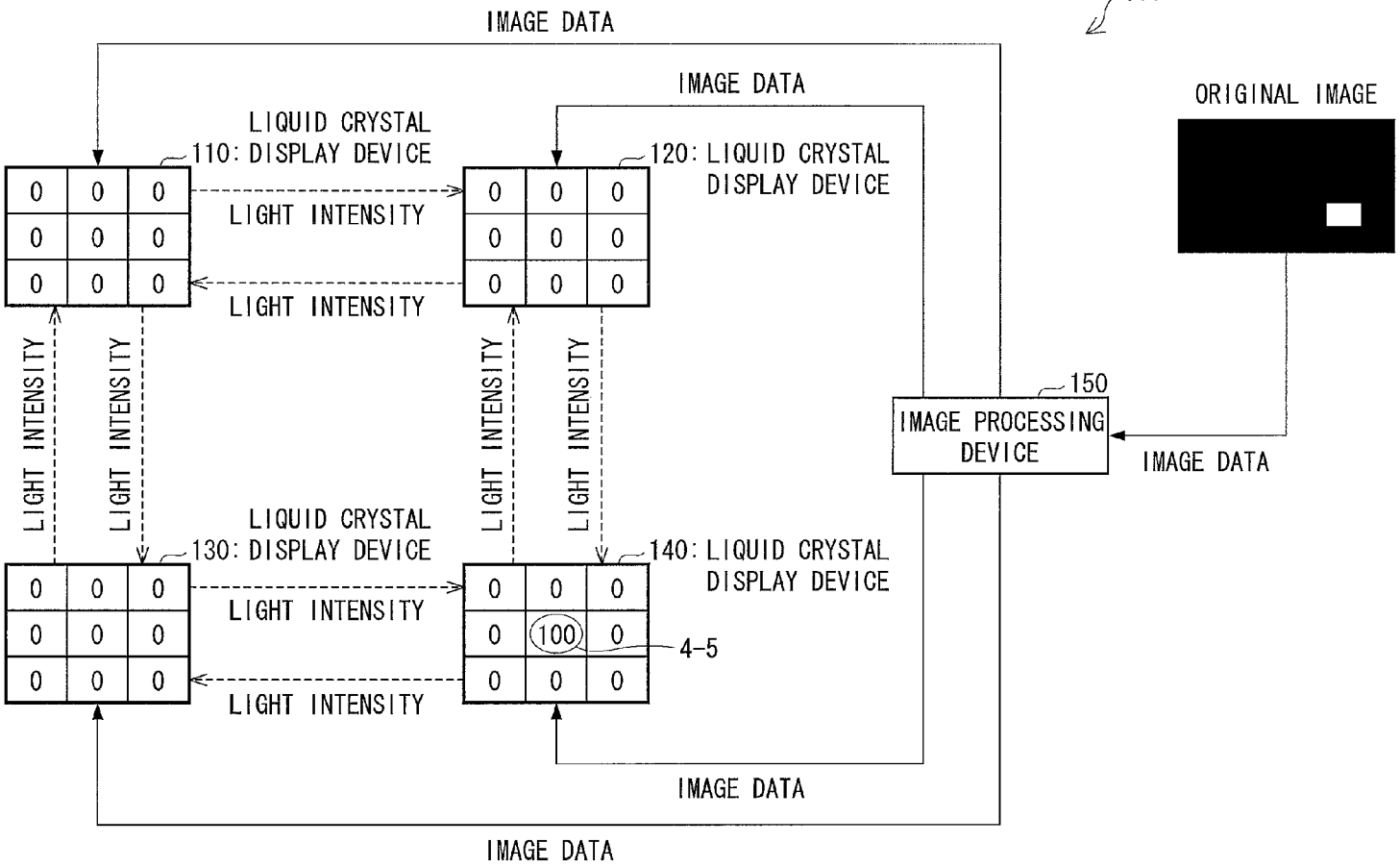
FIG. 11 illustrates examples of default values of light intensities of areas in the multi-display system in accordance with the present embodiment.

For example, in a case where an image (original image) is displayed in which the area (4-5) is white and all other areas are black, as illustrated in FIG. 11, the light intensity calculating section 701 of the liquid crystal display device 140 calculates the light intensity of the area (4-5) as 100%, and the light intensities of all other areas as 0%. And, the light intensity calculating section 701 of each of the liquid crystal display devices 110, 120, and 130 calculates light intensities of all areas belonging to the each liquid crystal display device as 0%.

Figure 15:
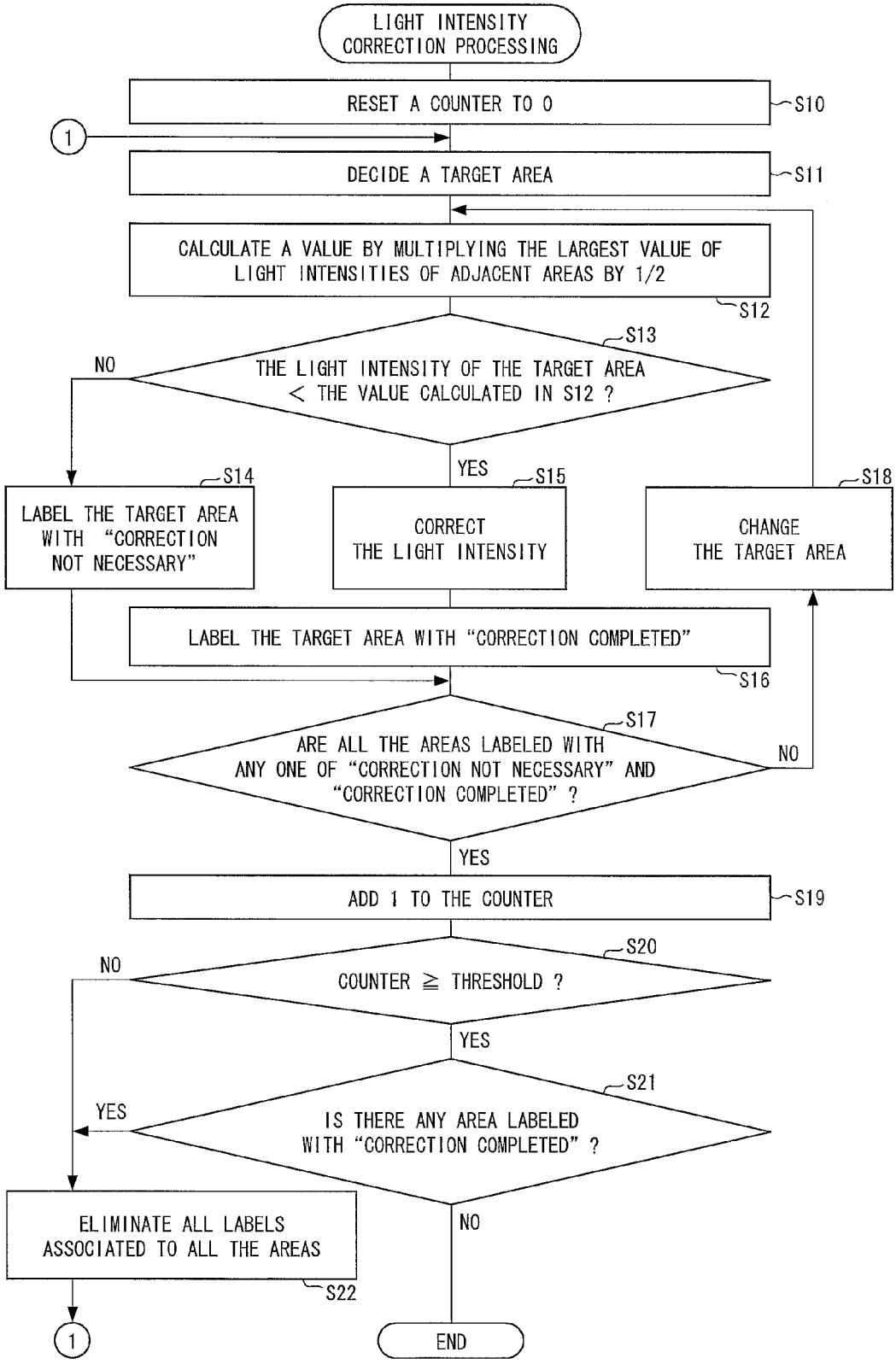
FIG. 15 is a flow chart illustrating a flow of the light intensity correction processing performed in each of the liquid crystal display devices included in the multi-display system in accordance with the present embodiment.

After the light intensity calculating section 701 calculates light intensities of own areas, the light intensity correcting section 702 of FIG. 10 inputs the light intensities and performs light intensity correction processing illustrated in FIG. 15. The following will describe the light intensity correction processing performed by the light intensity correcting section 702 of the liquid crystal display device 110, with reference to FIG. 15.

Although other light intensity correcting sections 702 of the liquid crystal display devices 120, 130, and 140 perform the light intensity correction processing as illustrated in FIG. 15, contents of the light intensity correction processing performed on the liquid crystal display devices 110, 120, 130, and 140 are equivalent, so that the following will merely describe the light intensity correction processing performed on the liquid crystal display device 110 and the descriptions of other light intensity correction processing performed on the liquid crystal display devices 120, 130, and 140 will be omitted, if not necessary.

First, the light intensity correcting section 702 resets a counter to 0 (S10). Then, the light intensity correcting section 702 decides as a target area any one of all the areas (1-1) through (1-9) of the liquid crystal display device 110 (S11).

Note that: in a case of the processing by the light intensity correcting section 702 of the liquid crystal display device 120, any one of all the areas of the liquid crystal display device 120 is decided as a target area; in a case of the processing by the light intensity correcting section 702 of the liquid crystal display device 130, any one of all the areas of the liquid crystal display device 130 is decided as a target area; and in a case of the processing by the light intensity correcting section 702 of the liquid crystal display device 140, any one of all the areas of the liquid crystal display device 140 is decided as a target area. The same applies to the step S18 which will be described later.

After S11, the light intensity correcting section 702 calculates a value by multiplying the largest light intensity of light intensities of adjacent areas by ½ (a value which is half the largest light intensity value), the adjacent areas being adjacent to the target area (S12). If the calculated value includes fractions below decimal point, the fractions are then rounded up. For example, in a case where the largest value of the light intensities of the adjacent areas is "25", a value "12.5" is obtained, but the value is rounded up to "13".

As with the case of S2 in FIG. 8, the adjacent areas refer to four areas; a right area right adjacent to a target area, a left area left adjacent to the target area, an upper area upward adjacent to the target area, and a lower area downward adjacent to the target area.

In S12 in FIG. 15, even in a case where an area included in a liquid crystal display device adjacent to the liquid crystal display device including the target area is adjacent to the target area, this area is treated as an adjacent area for the target area. For example, in a case where the area (1-8) illustrated in FIG. 9 is a target area, not only the areas (1-5) (1-7) (1-9) but also the area (3-2) is regarded as the adjacent area. Further, in a case where the area (1-9) is a target area, not only the areas (1-6) (1-8) but also the areas (2-7) (3-3) are regarded as the adjacent area.

As described above, each of the liquid crystal display devices 110, 120, 130, and 140 is capable of communicating data with other adjacent liquid crystal display devices. Accordingly, in a case where an adjacent area is included in a liquid crystal display device adjacent to the liquid crystal display device including the target area, the light intensity correcting section 702 of the liquid crystal display device including the target area accesses to this adjacent liquid crystal display device via a USB so as to detect (obtain) the light intensity of the adjacent area included in the adjacent liquid crystal display device (in other words, the light intensity correcting section 702 of the liquid crystal display device including the target area obtains, from the adjacent liquid crystal display device via a USB, light intensity data indicating the light intensity of this adjacent area). For example, in a case where the area (1-8) of the liquid crystal display device 110 is a target area, not only the areas (1-5), (1-7), and (1-9) of the liquid crystal display device 110 but also the area (3-2) of the liquid crystal display device 130 is regarded as the adjacent area. In this case, the light intensity correcting section 702 of the liquid crystal display device 110 accesses to the liquid crystal display device 130 via a USB so as to detect the light intensity of the area (3-2).

In a case where an area located at the end of the multi-display system 100 is a target area, there lacks one or two areas, of the left area, the right area, the upper area, and the lower area, so that there are only two or three adjacent areas. For example, in a case where the area (1-1) in FIG. 8 is a target area, only the areas (1-2) and (1-4) are adjacent areas, and the area (1-4) in FIG. 8 is a target area, only the areas (1-1), (1-5) and (1-7) are adjacent areas.

After S12, the light intensity correcting section 702 determines whether or not the light intensity of the target area is lower than the value calculated in S12 (S13). In a case where it is determined that the light intensity of the target area is not lower than the value calculated in S12, that is, the light intensity of the target area is equal to or higher than the value calculated in S12, the light intensity correcting section 702 labels the target area with "Correction Not Necessary" (S14), and the processing goes to S17.

In contrast, in a case where it is determined that the light intensity of the target area is lower than the value calculated in S12, the light intensity correcting section 702 corrects the light intensity of the target area (S15). Specifically, the light intensity correcting section 702 corrects, in S15, the light intensity of the target area to the value calculated in S12. After S15, the light intensity correcting section 702 labels the target area with "Correction Completed" (S16) and the processing goes to S17.

In S17, the light intensity correcting section 702 determines whether or not all the areas (1-1) through (1-9) of the liquid crystal display device 110 are labeled with any one of "Correction Not Necessary" and "Correction Completed". In a case where the light intensity correcting section 702 determines that not all the areas of the liquid crystal display device 110 are labeled with any one of "Correction Not Necessary" and "Correction Completed" (No in S17), the light intensity correcting section 702 changes the target area to an area which is labeled with none of "Correction Not Necessary" and "Correction Completed" (S18), and the processing from S12 is repeated. That is, the area labeled with none of "Correction Not Necessary" and "Correction Completed" is set to a target area (S18), and the processing from S12 is repeated. Therefore, the processing from S12 to S17 is repeated until all the areas included in the liquid crystal display device 110 have been once a target area. Whereas, in a case where the light intensity correcting section 702 determines that all the areas of the liquid crystal display device 110 are labeled with any one of "Correction Not Necessary" and "Correction Completed" (Yes in S17), the processing goes to S19.

In S19, the light intensity correcting section 702 adds 1 to the counter (increment). After S19, the light intensity correcting section 702 determines whether or not the value of the counter is equal to or more than a threshold (S20). In a case where the light intensity correcting section 702 determines that the value of the counter is not equal to or more than the threshold (No in S20), the light intensity correcting section 702 eliminates all labels associated to all the areas included in the liquid crystal display device 110 (S22), and the processing from S11 is repeated. Whereas, in a case where the light intensity correcting section 702 determines that the value of the counter is equal to or more than the threshold (Yes in S20), the processing goes to S21. The reason why S20 is provided will be described later.

In S21, the light intensity correcting section 702 determines whether or not there exists any area labeled with "Correction Completed" in the liquid crystal display device 110. In a case where the light intensity correcting section 702 determines that there exists an area labeled with "Correction Completed" in the liquid crystal display device 110 (Yes in S21), the light intensity correcting section 702 eliminates all labels associated to all the areas included in the liquid crystal display device 110 (S22), and the processing from S11 is repeated. Whereas, in a case where the light intensity correction sect ion 702 determines that there exists no area labeled with "Correction Completed" in the liquid crystal display device 110, the light intensity correcting section 702 ends the processing illustrated in the flow chart of FIG. 15. Accordingly, when the light intensity correction has been performed on at least one target area during one processing (on the premise that each area of the liquid crystal display device 110 is once treated as a target area, and the steps S2 through S7 performed to each area is regarded as one processing), another one processing will be repeated, whereas when no light intensity correction has been performed during one processing, the processing will end. Therefore, the one processing will be repeated until no light intensity correction is required for any of the areas of the liquid crystal display device 110.

Note that: the light intensity correcting section 702 of the liquid crystal display device 120 processes and determines, in the steps S17, S21, and S22, each area of the liquid crystal display device 120; the light intensity correcting section 702 of the liquid crystal display device 130 processes and determines, in the steps S17, S21, and S22, each area of the liquid crystal display device 130; and the light intensity correcting section 702 of the liquid crystal display device 140 processes and determines, in the steps S17, S21, and S22, each area of the liquid crystal display device 140.

The following will discuss why S20 is provided in the flow chart of FIG. 15. For example, in a case where an original image as illustrated in FIG. 11 is inputted, each area of each of the liquid crystal display devices 110, 120, 130, and 140 has a default light intensity value (the value calculated by the light intensity calculating section 701) as illustrated in FIG. 11. In this case, all areas of the liquid crystal display device 110 have light intensities of 0. Of areas of the liquid crystal display devices 120 and 130 being adjacent to the liquid crystal display device 110, the areas (3-1), (3-2), (3-3), (2-1), (2-4), and (2-7), which are adjacent to the areas (1-3), (1-6), (1-7), (1-8), and (1-9) of the liquid crystal display device 110, have also light intensities of 0 (see FIGS. 9 and 11). Therefore, in the situation illustrated in FIG. 11, if the light intensity correcting section 702 of the liquid crystal display device 110 performs only the above-mentioned one processing (on the premise that each area of the liquid crystal display device 110 is once treated as a target area, and the steps S2 through S7 performed to each area is regarded as one processing), there exists no area labeled with "Correction Completed". Provided the processing of S20 does not exist, the processing of FIG. 15 with respect to the liquid crystal display device 110 will end without performing the step of S15. In other words, if there is no step in S20, the processing will end disadvantageously in the situation of FIG. 12, although essentially the value illustrated in FIG. 11 should be corrected to the value illustrated in FIG. 12, which should be then corrected to the value illustrated in FIG. 13, which should further be corrected to the value illustrated in FIG. 14.

Providing the step of S20 as illustrated in FIG. 15 makes it possible to repeat the above-mentioned one processing at least the threshold number of times in each of the liquid crystal display devices 110, 120, 130, and 140. The threshold is a value larger than the value obtained by adding the number of the areas arranged in a lateral direction and the number of the areas arranged in a longitudinal direction of the multi-display system 100. In the example of FIG. 11, the numbers of the areas in both lateral and longitudinal directions are 6, so that the threshold can be a value equal to or more than 12. Accordingly, the steps from S2 to S6 performed to an area of a liquid crystal display device included in the multi-display system 100 can be repeated until the values of an adjacent area in an adjacent liquid crystal display device become constant. This allows preventing the above-mentioned disadvantage.

Figure 12:
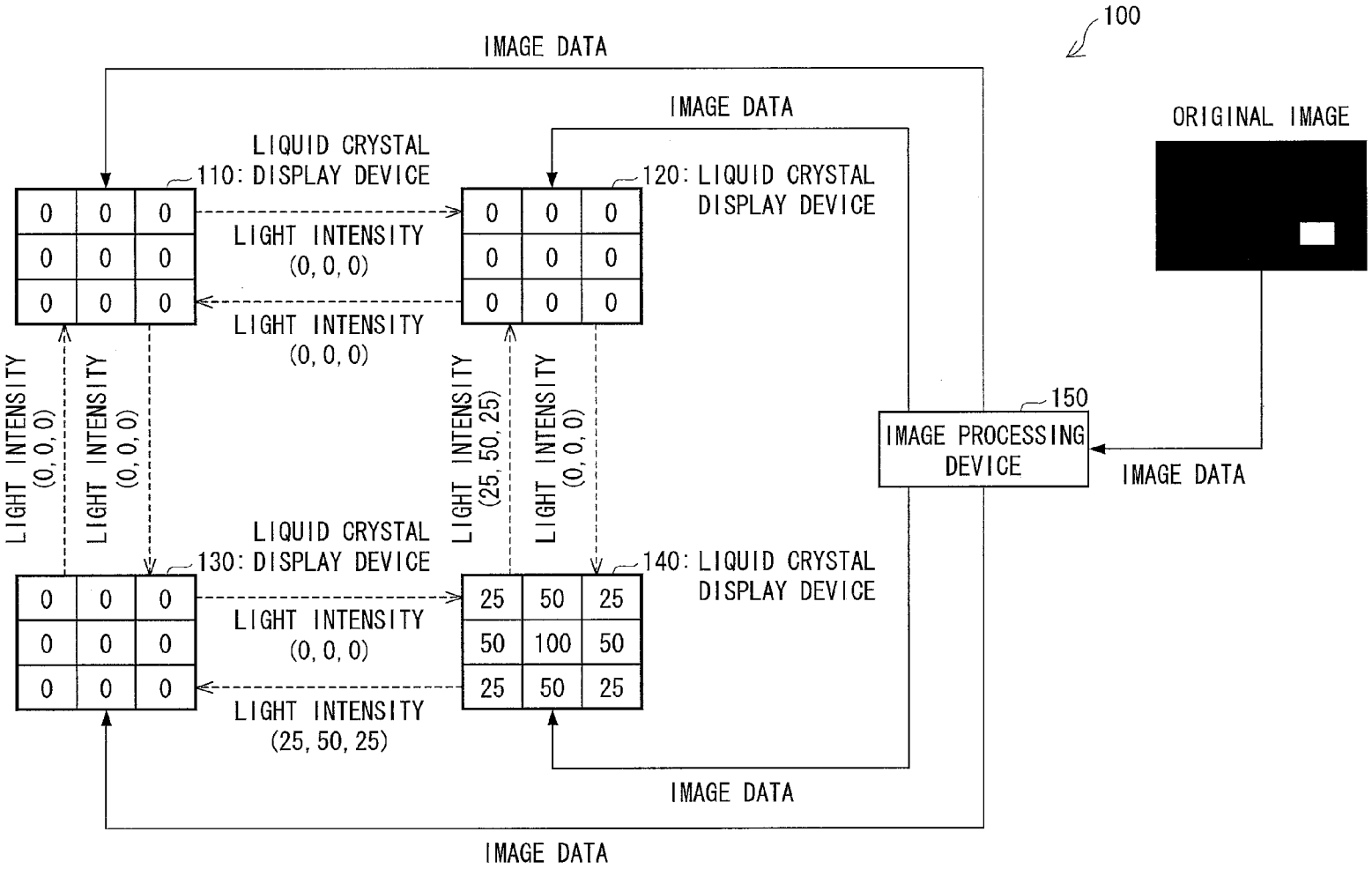
FIG. 12 is a first diagram illustrating a course of light intensity correction processing performed with respect to each area in the multi-display system in accordance with the present embodiment.
Figure 13:
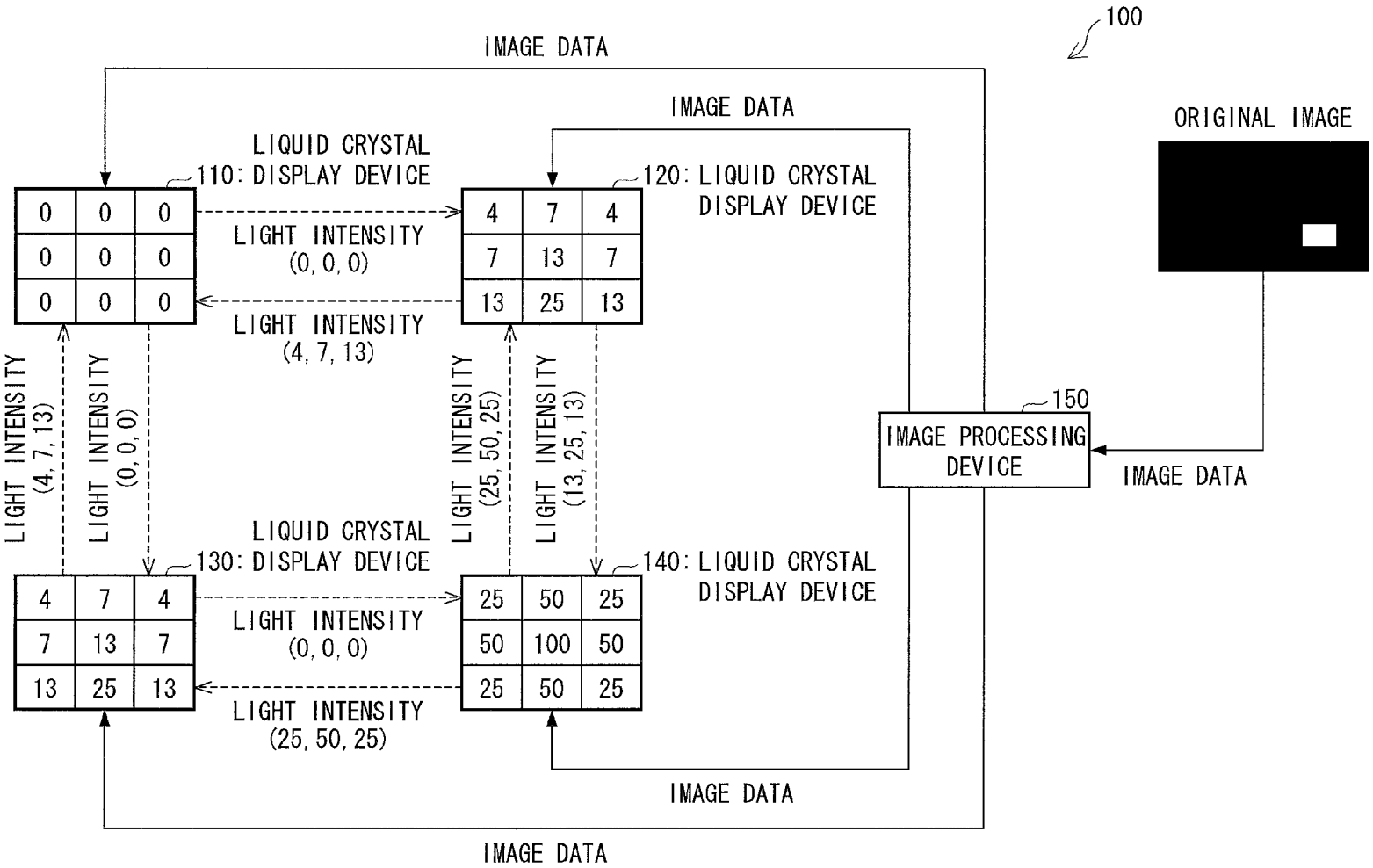
FIG. 13 is a second diagram illustrating a further course of light intensity correction processing performed with respect to each area in the multi-display system in accordance with the present embodiment.

As the result of the above-mentioned processing of FIG. 15 performed in each of the liquid crystal display devices 110, 120, 130, and 140, light intensities of the areas of the liquid crystal display device 140 will be first corrected from the default values illustrated in FIG. 11 to the values illustrated in FIG. 12. Subsequently, the liquid crystal display devices 120 and 130 access to the liquid crystal display device 140 to obtain the light intensities, and correct the light intensities of the respective liquid crystal display devices 120 and 130 in accordance with obtained light intensities. Consequently, the light intensities of areas of the liquid crystal display devices 110, 120, 130, and 140 of the multi-display system 100 will be corrected from the values illustrated in FIG. 12 to the values illustrated in FIG. 13. Subsequently, the liquid crystal display device 110 access to the liquid crystal display devices 120 and 130 to obtain the light intensities, and correct the light intensities of the liquid crystal display device 110 in accordance with obtained light intensities. Consequently, the light intensities of the liquid crystal display devices 110, 120, 130, and 140 of the multi-display system 100 will be corrected from the values illustrated in FIG. 13 to the values illustrated in FIG. 14.

And, each light intensity correcting section 702 of the liquid crystal display devices 110, 120, 130, and 140 sends light intensity data indicating the corrected light intensities of the areas to the backlight device. The backlight device will emit light on the basis of the light intensity data received from the each light intensity correcting section 702.

As the result of the processing described above, the light intensities of areas, which are adjacent to each other, are corrected such that the smaller light intensity of the areas is not less than a half the larger light intensity. This allows reducing a difference in luminance of black between the areas which are adjacent to each other. Specifically, according to the multi-display system 100 of the present embodiment, light intensities of areas, which are adjacent to each other at an interface between one liquid crystal display device and another adjacent liquid crystal display device, are corrected such that the smaller light intensity is not less than a half the larger light intensity. This also allows reducing a difference in luminance of black between the areas which are adjacent to each other at an interface between one liquid crystal display device and another adjacent liquid crystal display device.

As described above, the multi-display system 100 in accordance with the present embodiment includes the liquid crystal display devices 110, 120, 130, and 140 having a plurality of areas in each of which a backlight intensity can be adjusted, wherein, of the liquid crystal display devices 110, 120, 130, and 140, adjacent liquid crystal display devices are connected to each other communicatably via a communication section (for example, a USB). And each of the liquid crystal display devices 110, 120, 130, and 140 includes: a light intensity calculating section (light intensity output section) 701 for setting a backlight intensity of a target area included in the each of the liquid crystal display devices 110, 120, 130, and 140 on the basis of image data of an image to be displayed on the target area; and a light intensity correcting section 702 for correcting the backlight intensity of the target area in accordance with backlight intensities of adjacent areas which are areas adjacent to the target area. In a case where another liquid crystal display device which is adjacent to the liquid crystal display device including the target area includes one of the adjacent areas, the light intensity correcting section 702 accesses to this liquid crystal display device including the adjacent area via a USB so as to detect the backlight intensity of the adjacent area, in order to correct the backlight intensity of the target area in accordance with the detected backlight intensity of the adjacent area.

According to the multi-display system 100 of the present embodiment, it is possible to correct the backlight intensity of the target area, in accordance with the backlight intensities of the adjacent areas which are adjacent to the target area. Specifically, even in a case where another liquid crystal display device which is adjacent to the liquid crystal display device including the target area includes one of the adjacent areas, it is possible to correct the backlight intensity of the target area in accordance with backlight intensity of the adjacent area. This allows avoiding a difference in luminance between adjacent areas in a liquid crystal display device, in a case where the areas display sub-images whose average luminance components or the like are same or approximate. This further allows avoiding a significant difference in luminance between light intensity control areas which are adjacent to each other at an interface between one liquid crystal display device and another adjacent liquid crystal display device, in a case where the areas display sub-images whose average luminance components or the like are same or approximate. Therefore, it is possible to prevent a multi-display system including a plurality of liquid crystal display devices arranged in array from displaying an image that appears unnatural.

Figure 14:
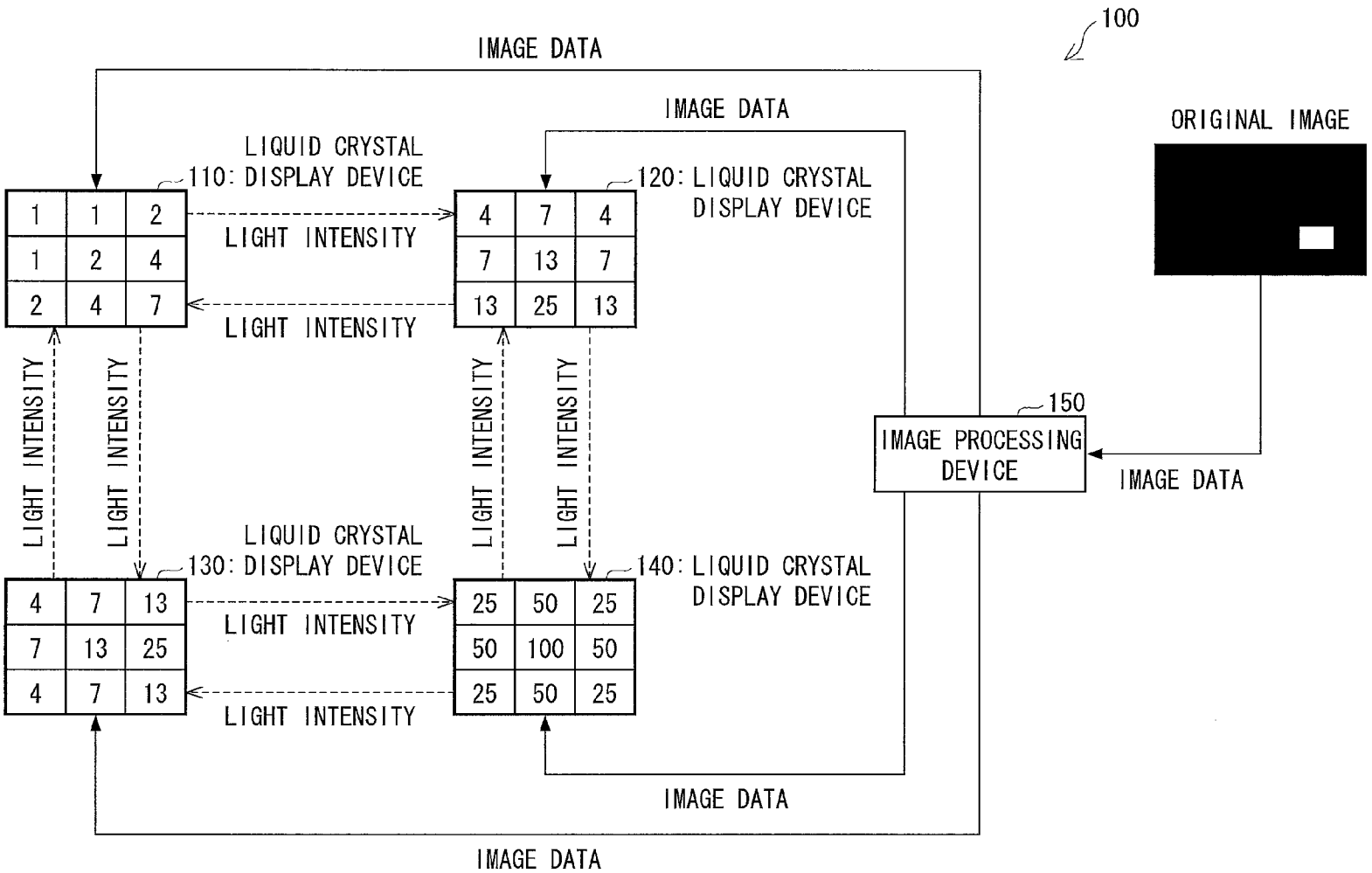
FIG. 14 illustrates corrected light intensities of the areas in the multi-display system in accordance with the present embodiment.

More specifically, as the result of the processing illustrated in FIG. 15 performed to the multi-display system 100 in accordance with the present embodiment, the correction is performed such that the maximum value (absolute value) of the difference in backlight intensity of areas adjacent to each other is lower after the correction than before the correction (the maximum value before the light intensity correction is 100 as illustrated in FIG. 11, whereas the maximum value after the light intensity correction is 50 as illustrated in FIG. 14). Further, light intensities of adjacent areas are corrected such that the smaller light intensity is not less than a half the larger light intensity. Consequently, assuming that a histogram where a horizontal axis indicates locations of areas and a vertical axis indicates light intensities of the areas is illustrated, changes in difference in light intensity before the light intensity correction are sharp (see in FIG. 11) whereas changes in difference in light intensity after the light intensity correction are mild (see corrected light intensity data illustrated in FIG. 14). This allows displaying an image in which a significant difference in luminance between areas adjacent to each other is prevented, i.e., the disadvantage of local dimming is overcome.

Furthermore, in the present embodiment, the light intensity correcting section 702 treats, as a target area, all areas included in a liquid crystal display device, to which the light intensity correcting section 702 belongs, one after another, and determines (S13) whether or not the backlight intensity of the target area is smaller than a value obtained by multiplying the largest adjacent light intensity by 1/n (n=2), the largest adjacent light intensity referring to the largest light intensity of backlight intensities of adjacent areas located adjacent to the target area. The light intensity correcting section 702 does not correct the backlight intensity of the target area in a case where the backlight intensity of the target area is not smaller than the value obtained by multiplying the largest adjacent light intensity by 1/n (S14), but corrects the backlight intensity of the target area to the value obtained by multiplying the largest adjacent light intensity by 1/n, in a case where the backlight intensity of the target area is smaller than the value obtained by multiplying the largest adjacent light intensity by 1/n (S15). This makes it possible to perform the light intensity correction for each area so that, of two areas which are adjacent to each other, the smaller light intensity is not less than a value obtained by multiplying the larger light intensity by 1/n. However, n is not limited to 2, and can be any value which is larger than 1 (an integer and a decimal fraction).

In the present embodiment, the light intensity of the backlight device has been denoted in percentage (%), where the maximum value of the output light intensity is 100. However, the denotation is not limited to this, and the light intensity of the backlight device may be denoted, for example, in a decimal fraction(s) smaller than 1 (a value with N decimal place(s)), where the maximum value of the output light intensity is 1. Note that, in this case, a fraction on the N+1 th decimal place of the calculated value will be rounded up, instead fractions below decimal point of the calculated value in the case of S12 in FIG. 15. For example, in a case where the light intensity of the backlight device is denoted in a value with two decimal places (0.00), the value "0.225" calculated in S12 in FIG. 15 will be rounded up to "0.23".

In the present embodiment, the light intensity of the target area is corrected to a value obtained by multiplying the largest adjacent light intensity (the largest light intensity of backlight intensities of adjacent areas adjacent to the target area) by 1/n, it is not limited to such a correction. Essentially, any correction is possible which is performed so that the light intensity of the target area is corrected depending on light intensities of adjacent areas. Accordingly, the present invention is not limited to the correction such that the light intensity of the target area is corrected to a value obtained by multiplying the largest adjacent light intensity by 1/n. For example, a threshold is set depending on the largest adjacent light intensity, and determination is made whether or not the difference between the light intensity of the target area and the largest adjacent light intensity is larger than the threshold. In a case where it is determined that the difference between the light intensity of the target area and the largest adjacent light intensity is larger than the threshold, addition can be made to the light intensity of the target area so that the difference is equal to the threshold. Alternatively, an average of the light intensity of the target area and the largest adjacent light intensity can be defined as the corrected light intensity of the target area, in a case where it is determined that the difference between the light intensity of the target area and the largest adjacent light intensity is larger than the threshold.

Alternatively, it can be set that, if the contents (method) of the light intensity correction prefers to using a computing equation, the computing equation is used to output a correction value, whereas in a case where the contents (method) of the light intensity correction prefers to using a correction table, the correction table is used to output a correction value.

Although the light intensity determining section 700 has been described, which includes members made from integrated circuits, the light intensity determining section 700 may be a computer including a processor, a ROM, a RAM, and the like. In this case, the processing at each members included in the light intensity determining section 700 is performed by a program operated by a computer. The program may be a program which is stored in removable media, such as a CD-ROM (computer-readable storage medium), and read out to be used, or a program which is installed in a hard disk and read out to be used.

In order to solve the above-mentioned problem, the multi-display system in accordance with the present embodiment includes a plurality of liquid crystal display devices each of which includes a plurality of light intensity control areas, in each of which light intensity control areas a backlight intensity can be adjusted, wherein: liquid crystal display devices, which are adjacent to each other, are connected to each other communicatably via a communication section, and each of the plurality of liquid crystal display devices comprises a light intensity output section and a light intensity correcting section, the light intensity output section being configured to set a backlight intensity of each of light intensity control areas belonging to a liquid crystal display device including the light intensity output section, the light intensity output section setting the backlight intensity on the basis of image data of an image to be displayed on the each of light intensity control areas, the light intensity correcting section being configured to perform a light intensity correction in which the backlight intensity of each of light intensity control areas belonging to a liquid crystal display device including the light intensity correcting section is corrected in accordance with backlight intensities of adjacent areas which are adjacent to the light intensity control area, and, in a case where another liquid crystal display device which is adjacent to the liquid crystal display device including the light intensity correcting section includes one of the adjacent areas, the light intensity correcting section accessing to the another liquid crystal display device including the one of the adjacent areas via the communication section so as to obtain the backlight intensity of the one of the adjacent areas, in order to perform the light intensity correction in accordance with the obtained backlight intensity of the one of the adjacent areas.

According to the configuration of the present invention, the light intensity correcting section can perform a light intensity correction in which the backlight intensity of each of the light intensity control areas belonging to the liquid crystal display device including the light intensity correcting section is corrected in accordance with backlight intensities of adjacent areas which are adjacent to the light intensity control area. In particular, the light intensity correcting section in accordance with the present invention can correct the backlight intensity of each of the light intensity control areas belonging to the liquid crystal display device including the light intensity correcting section in accordance with backlight intensities of adjacent areas, even in a case where another liquid crystal display device which is adjacent to the liquid crystal display device including the light intensity correcting section includes one of the adjacent areas.

Therefore, the present invention can avoid a significant difference in brightness between light intensity control areas adjacent to each other in a liquid crystal display device, in a case where the light intensity control areas display sub-images whose average luminance components or the like are same or approximate. Moreover, the present invention can avoid a significant difference in brightness between light intensity control areas which are adjacent to each other at an interface between one liquid crystal display device and another adjacent liquid crystal display device, in a case where the light intensity control areas display sub-images whose average luminance components or the like are same or approximate. It is therefore possible to prevent the multi-display system including a plurality of liquid crystal display devices arranged in array from displaying an image that appears unnatural.

In the multi-display system in accordance with the present embodiment, the light intensity correcting section performs the light intensity correction such that a maximum value of differences in backlight intensities between light intensity control areas which are adjacent to each other is reduced.

Further in the multi-display system in accordance with the present embodiment, the light intensity correcting section performs the light intensity correction such that, of light intensities of two light intensity control areas which are adjacent to each other, the smaller light intensity is not less than a value obtained by multiplying the larger light intensity by 1/n, where n>1.

Furthermore in the multi-display system in accordance with the present embodiment, the light intensity correcting section (i) treats, as a target area, all the light intensity control areas belonging to the liquid crystal display device comprising the light intensity correcting section one after another, (ii) determine whether or not the backlight intensity of the target area is smaller than a value obtained by multiplying a largest adjacent light intensity by 1/n, the largest adjacent light intensity referring to a largest light intensity of the backlight intensities of the adjacent areas located adjacent to the target area, and (iii) does not correct the backlight intensity of the target area in a case where the backlight intensity of the target area is not smaller than the value obtained by multiplying the largest adjacent light intensity by 1/n, but corrects the backlight intensity of the target area to the value obtained by multiplying the largest adjacent light intensity by 1/n in a case where the backlight intensity of the target area is smaller than the value obtained by multiplying the largest adjacent light intensity by 1/n.

The present invention is not limited to the above-mentioned embodiments, and various modifications are possible within a scope defined by Claims. The technical scope of the present invention encompasses embodiments obtained by appropriately combining the technical means disclosed in different embodiments.

INDUSTRIAL APPLICABILITY

The present invention is applicable to a multi-display system including a plurality of liquid crystal display devices arranged in array.

REFERENCE SIGNS LIST

100 Multi-display system
110 Liquid crystal display device
120 Liquid crystal display device
130 Liquid crystal display device
140 Liquid crystal display device
150 Image processing device
700 Light intensity determining section
701 Light intensity calculating section (Light intensity output section)
702 Light intensity correcting section

The invention claimed is:

1. A multi-display system comprising a plurality of liquid crystal display devices each of which includes a plurality of light intensity control areas, in each of which light intensity control areas a backlight intensity can be adjusted, wherein:

liquid crystal display devices, which are adjacent to each other, are connected to each other communicatably via a communication section, each of the plurality of liquid crystal display devices comprises a light intensity output section and a light intensity correcting section, the light intensity output section is configured to set a backlight intensity of each of light intensity control areas belonging to a liquid crystal display device comprising the light intensity output section, the light intensity output section setting the backlight intensity on the basis of image data of an image to be displayed on the each of light intensity control areas, the light intensity correcting section is configured to perform a light intensity correction in which the backlight intensity of each of light intensity control areas belonging to a liquid crystal display device comprising the light intensity correcting section is corrected in accordance with backlight intensities of adjacent areas which are adjacent to the light intensity control area, in a case where another liquid crystal display device which is adjacent to the liquid crystal display device comprising the light intensity correcting section includes one of the adjacent areas, the light intensity correcting section accesses the another liquid crystal display device including the one of the adjacent areas via the communication section so as to obtain the backlight intensity of the one of the adjacent areas, in order to perform the light intensity correction in accordance with the obtained backlight intensity of the one of the adjacent areas, and the light intensity correcting section (i) treats, as a target area, all the light intensity control areas belonging to the liquid crystal display device comprising the light intensity correcting section one after another, (ii) determines whether or not the backlight intensity of the target area is smaller than a value obtained by multiplying a largest adjacent light intensity by 1/n, where n>1, the largest adjacent light intensity referring to a largest light intensity of the backlight intensities of the adjacent areas located adjacent to the target area, and (iii) does not correct the backlight intensity of the target area in a case where the backlight intensity of the target area is not smaller than the value obtained by multiplying the largest adjacent light intensity by 1/n, but corrects the backlight intensity of the target area to the value obtained by multiplying the largest adjacent light intensity by 1/n in a case where the backlight intensity of the target area is smaller than the value obtained by multiplying the largest adjacent light intensity by 1/n, such that, of backlight intensities of two light intensity control areas which are adjacent to each other, the smaller backlight intensity is not less than a value obtained by multiplying the larger backlight intensity by 1/n, causing reduction of a maximum value of differences in the backlight intensities between the two light intensity control areas which are adjacent to each other.

* * * * *